US007629099B2

(12) United States Patent
Yamashita et al.

(10) Patent No.: US 7,629,099 B2
(45) Date of Patent: Dec. 8, 2009

(54) TONER, DEVELOPER, IMAGE FORMING METHOD, AND TONER CONTAINER

(75) Inventors: Hiroshi Yamashita, Numazu (JP); Tsuyoshi Sugimoto, Yokohama (JP); Hiroto Higuchi, Machida (JP); Yohichiroh Watanabe, Fuji (JP); Yasuhiro Shindo, Kyoto (JP)

(73) Assignee: Ricoh Company Limited, Tokyo (JP)

( * ) Notice: Subject to any disclaimer, the term of this patent is extended or adjusted under 35 U.S.C. 154(b) by 471 days.

(21) Appl. No.: 11/487,374

(22) Filed: Jul. 17, 2006

(65) Prior Publication Data

US 2007/0015077 A1 Jan. 18, 2007

(30) Foreign Application Priority Data

Jul. 15, 2005 (JP) ..... 2005-207650

(51) Int. Cl.
*G03G 9/00* (2006.01)

(52) U.S. Cl. ..... 430/109.4; 430/137.1; 430/123.5

(58) Field of Classification Search ..... 430/109.4, 430/137.1, 123.5
See application file for complete search history.

(56) References Cited

U.S. PATENT DOCUMENTS

| | | | | |
|---|---|---|---|---|
| 4,584,254 | A | 4/1986 | Nakayama et al. | |
| 4,620,987 | A | 11/1986 | Yamashita et al. | |
| 4,672,016 | A | 6/1987 | Isoda et al. | |
| 4,885,350 | A | 12/1989 | Yamashita et al. | |
| 4,908,290 | A | 3/1990 | Watanabe et al. | |
| 4,927,728 | A | 5/1990 | Isoda et al. | |
| 4,956,258 | A | 9/1990 | Watanabe et al. | |
| 5,288,577 | A | 2/1994 | Yamaguchi et al. | |
| 5,368,972 | A | 11/1994 | Yamashita et al. | |
| 5,418,103 | A | 5/1995 | Muto et al. | |
| 5,429,901 | A | 7/1995 | Muto et al. | |
| 5,541,031 | A | 7/1996 | Yamashita et al. | |
| 5,565,298 | A | 10/1996 | Suguro et al. | |
| 5,576,393 | A | 11/1996 | Yamashita et al. | |
| 5,667,927 | A * | 9/1997 | Kubota et al. | 430/108.1 |
| 5,750,299 | A | 5/1998 | Ohshima et al. | |
| 6,037,090 | A | 3/2000 | Tanaka et al. | |
| 6,074,795 | A | 6/2000 | Watanabe et al. | |
| 6,103,441 | A | 8/2000 | Tomita et al. | |

(Continued)

FOREIGN PATENT DOCUMENTS

EP 0 640 882 B1 3/1995

(Continued)

OTHER PUBLICATIONS

U.S. Appl. No. 12/048,741, filed Mar. 14, 2008, Moriya, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

A toner is provided manufactured by a method having the steps: dispersing toner constituents including a resin, in an aqueous medium containing a particulate resin, wherein the resin has a polyester skeleton formed by a ring-opening addition reaction of a cyclic ester with a first compound having an active hydrogen group; and a developer and an image forming method using the toner, and a toner container containing the toner.

24 Claims, 5 Drawing Sheets

U.S. PATENT DOCUMENTS 6,140,000 A 10/2000 Yamashita
6,180,298 B1 1/2001 Kuroda et al.
6,228,550 B1 5/2001 Matsuda et al.
6,329,115 B1 12/2001 Yamashita
6,335,137 B1 1/2002 Suzuki et al.
6,360,068 B1 3/2002 Kinoshita et al.
6,363,229 B1 3/2002 Shiraishi et al.
6,403,275 B1 6/2002 Kuramoto et al.
6,416,914 B1 7/2002 Nakamura et al.
6,468,706 B2 10/2002 Matsuda et al.
6,503,676 B2 1/2003 Yamashita et al.
6,544,704 B1 4/2003 Matsuda et al.
6,566,026 B2 5/2003 Watanabe et al.
6,593,048 B2 7/2003 Sasaki et al.
6,632,579 B1 10/2003 Yamashita
6,653,037 B2 11/2003 Sawada et al.
6,656,654 B2 12/2003 Higuchi et al.
6,660,443 B2 12/2003 Sugiyama et al.
6,667,141 B2 12/2003 Iwamoto et al.
6,682,866 B2 1/2004 Sugiyama et al.
6,699,632 B2 3/2004 Higuchi et al.
6,716,561 B2 4/2004 Shiraishi et al.
6,740,460 B2 5/2004 Tomita et al.
6,740,461 B2 5/2004 Yamashita et al.
6,756,175 B2 6/2004 Emoto et al.
6,787,280 B2 9/2004 Yamashita et al.
6,790,575 B2 9/2004 Sasaki et al.
6,800,412 B2 10/2004 Sugiyama et al.
6,811,944 B2 11/2004 Higuchi et al.
6,813,461 B2 11/2004 Higuchi et al.
6,821,698 B2 11/2004 Sawada et al.
6,824,945 B2 11/2004 Emoto et al.
6,830,859 B2 12/2004 Shiraishi et al.
6,835,517 B2 12/2004 Kondo et al.
6,835,519 B2 12/2004 Sugiyama et al.
6,846,604 B2 1/2005 Emoto et al.
6,849,369 B2 2/2005 Yagi et al.
6,852,459 B2 2/2005 Katoh et al.
6,852,462 B2 2/2005 Emoto et al.
6,855,468 B1 2/2005 Yamamoto et al.
6,856,781 B2 2/2005 Matsuda et al.
6,911,289 B2 6/2005 Higuchi et al.
6,924,073 B2 8/2005 Higuchi et al.
6,934,484 B2 8/2005 Suzuki et al.
6,939,653 B2 9/2005 Suzuki et al.
6,946,229 B2 9/2005 Suzuki et al.
6,947,692 B2 9/2005 Kondo et al.
6,977,129 B2 12/2005 Saito et al.
7,005,223 B2 2/2006 Yamashita et al.
7,029,816 B2 4/2006 Sasaki et al.
7,049,037 B2 5/2006 Katoh et al.
7,052,815 B2 5/2006 Sawada et al.
7,056,636 B2 6/2006 Tomita et al.
7,056,638 B1 6/2006 Tomita et al.
2002/0039698 A1 4/2002 Sasaki et al.
2003/0027066 A1 2/2003 Yamashita et al.
2003/0036010 A1 2/2003 Suzuki et al.
2003/0096185 A1 5/2003 Yamashita et al.
2003/0165764 A1* 9/2003 Suwa et al. ..... 430/109.4
2003/0219669 A1 11/2003 Yamashita et al.
2004/0053154 A1 3/2004 Tomita et al.
2004/0115551 A1 6/2004 Sugiyama et al.
2004/0131961 A1 7/2004 Watanabe et al.
2004/0137344 A1 7/2004 Yamashita et al.
2004/0146795 A1 7/2004 Emoto et al.
2004/0185365 A1 9/2004 Saito et al.
2004/0209181 A1 10/2004 Higuchi et al.
2005/0003288 A1 1/2005 Sugiyama et al.
2005/0079433 A1 4/2005 Watanabe et al.
2005/0112488 A1 5/2005 Yamada et al.
2005/0164114 A1 7/2005 Yagi et al.
2005/0196691 A1 9/2005 Ohtani et al.
2005/0196692 A1 9/2005 Yamashita et al.
2005/0238982 A1 10/2005 Suzuki et al.
2005/0250036 A1 11/2005 Emoto et al.
2005/0277046 A1 12/2005 Sawada et al.
2006/0063081 A1 3/2006 Nagatomo et al.
2006/0068312 A1 3/2006 Yamashita et al.

FOREIGN PATENT DOCUMENTS

EP 1 107 069 A1 6/2001
EP 1 243 976 A2 9/2002
EP 1 283 236 A1 2/2003
JP 60-214368 10/1985
JP 63-225244 9/1988
JP 04-313760 11/1992
JP 07-120975 5/1995
JP 09-274335 10/1997
JP 9-281746 10/1997
JP 09-319144 12/1997
JP 2001-166537 6/2001
JP 2002-284881 10/2002
JP 2004-12834 1/2004
JP 2004-054139 2/2004
JP 2004-177621 6/2004
JP 2006-284614 10/2006

OTHER PUBLICATIONS

U.S. Appl. No. 12/049,686, filed Mar. 17, 2008, Kotsugai, et al.
U.S. Appl. No. 11/734,895, filed Apr. 13, 2007, Yamashita, et al.
U.S. Appl. No. 11/752,343, filed May 23, 2007, Nagatomo, et al.
Robert F. Fedors, "A Method for Estimating Both the Solubility Parameters and Molar Volumes of Liquids", Polymer Engineering and Science, Feb. 1974, vol. 14, No. 2, pp. 147-154.
U.S. Appl. No. 11/868,618, filed Oct. 8, 2007, Sugiyama, et al.
U.S. Appl. No. 11/854,842, filed Sep. 13, 2007, Sugimoto, et al.
U.S. Appl. No. 11/857,999, filed Sep. 19, 2007, Yamashita, et al.
U.S. Appl. No. 12/209,583, filed Sep. 12, 2008, Seshita, et al.

* cited by examiner

TONER, DEVELOPER, IMAGE FORMING METHOD, AND TONER CONTAINER

BACKGROUND OF THE INVENTION

1. Field of the Invention

The present invention relates to a toner and a developer for use in electrophotography. In addition, the present invention also relates to an image forming method using the toner, and a toner container containing the toner.

2. Discussion of the Background

In an electrophotographic apparatus or an electrostatic recording apparatus, an electric latent image or a magnetic latent image is visualized with a toner. For example, in electrophotography, an electrostatic latent image formed on a photoreceptor is developed with a toner to form a toner image. The toner image is typically transferred onto a transfer material, and then fixed upon application of heat. Typically, a toner for use in an electrostatic latent image development is a colored particulate material in which a colorant, a charge controlling agent, and other additives are dispersed in a binder resin. Toner manufacturing methods are broadly classified into pulverization methods and polymerization methods.

In a pulverization method, a colorant, a charge controlling agent, an offset-inhibitor, etc. are mixed and melt-kneaded with a thermoplastic resin, and then the mixture is pulverized and classified to prepare toner particles. Pulverized toners typically have properties on a reasonable level, however, materials that can be used for the pulverized toners are limited. For example, the melt-kneaded mixture has to be pulverized and classified using an economically usable apparatus. Therefore, the melt-kneaded mixture has to be brittle. In this case, particles having various particle diameters tend to be produced, i.e., the resultant toner has a broad particle diameter distribution. In order to produce high definition and high gradation images, for example, fine particles having a particle diameter of not greater than 5 μm and coarse particles having a particle diameter of not less than 20 μm have to be removed, resulting in deterioration of the toner yield. In addition, it is difficult to uniformly disperse toner components (such as a colorant and a charge controlling agent) in a thermoplastic resin in the melt-kneading process. When the toner components are insufficiently dispersed in the thermoplastic resin, the resultant toner has poor fluidity, developability, and durability, and cannot produce high quality images.

On the other hand, a dissolution suspension method for preparing toner is known. In the dissolution suspension method, a resin solution in which a resin is dissolved in a solvent is dispersed in an aqueous medium including a dispersing agent or a dispersing auxiliary agent (such as a surfactant and a water-soluble resin), and then the solvent is removed upon application of heat or under reduced pressure to prepare toner particles. However, the toner particles have various particle diameters, i.e., the toner has a broad particle diameter distribution and therefore the classification process is needed.

Japanese Patent No. (hereinafter referred to as JP) 3344214 discloses a dissolution suspension method using a particulate inorganic material (such as a calcium carbonate and a silica) as a dispersion stabilizer to prepare resin particles having a uniform particle diameter. However, in this method, the particulate inorganic material adheres to the resin particles. Even if the resin particles are subjected to the particulate inorganic material removal process, a slight amount of the particulate inorganic material or inorganic ions tend to remain on the surface of the resin particles and deteriorates electric property, thermal property, and chemical stability of the resultant toner.

In attempting to solve this problem, JP 3455523 discloses a dissolution suspension method using a particulate resin (such as a vinyl resin) as a dispersion stabilizer to prepare resin particles (i.e., toner particles) having a uniform particle diameter. However, the particulate resin also tends to adhere to the surface of the toner particles. Since polarity and molecular weight of the particulate resin are different from those of the toner particles, each of the toner particles cannot be fused with each other when the toner is fixed. As a result, interfaces between the toner particles are not homogeneous. In addition, since the toner particles and the particulate resin include different resin components, light is refracted and scattered at interfaces of the toner particles in the toner layer, resulting in deterioration of transparency of the toner layer. Particularly, when the toner is a color toner (for producing a full color image) using a polyester resin having different polarity from and less compatibility with the particulate resin, the toner may not reproduce a native color thereof when layers of the color toners (e.g., yellow toner, magenta toner, cyan toner, etc.) are overlaid. For this reason, it is difficult to produce high quality images having the same quality as high-class printing images.

On the other hand, a toner is required to have good releasability from a heating member such as a heat roller used in a contact heat fixing method. (This property is hereinafter referred to as hot offset resistance.) In a toner prepared by the dissolution suspension method, the hot offset resistance can be improved by using a modified polyester resin formed by a reaction of a precursor of a polyester resin. However, since the modified polyester resin and a main binder resin are different in composition and polarity, these resins are less compatible with each other. As a result, transparency of the toner layer deteriorates and high quality full color images are difficult to be produced.

Besides the hot offset resistance, a toner is required to have low temperature fixability. Conventionally, resins such as styrene-acrylic resins, polyester resins, and epoxy resins have been widely used as a binder resin. Recently, cross-linked polyesters are used as a binder resin because of having good low-temperature fixability.

In attempting to improve both hot offset resistance and low temperature fixability, published examined Japanese Patent Applications Nos. (hereinafter referred to as JP-B) 4-44744 and 7-86699, and JP 305167 have disclosed toners using two kinds of polyester resins having different molecular weight distributions. These toners have relatively well-balanced hot offset resistance and low temperature fixability, compared to conventional toners using one polyester resin. However, the toners have a drawback in that since the two polyester resins having different softening points are mixed in powder states, the mixture has less uniformity, and as a result, a colorant cannot be uniformly dispersed in the toner. If the softening points of these two resins are closer to each other, the colorant dispersibility improves, but the balance between hot offset resistance and low temperature fixability deteriorates.

On the other hand, a toner typically includes a binder resin in an amount of not less than 70%. Since most of the conventional binder resins are made from oil resources, there are concerns of depletion of the oil resources and the global-warming problem caused by discharge of a huge amount of carbon dioxide gas into the air due to heavy consumption of the oil resources. If a binder resin can be synthesized from a plant which grows by utilizing carbon dioxide gas in the air, the carbon dioxide gas can be circulated. Namely, there is a possibility of preventing the global-warming and the depletion of the oil resources. Therefore, polymers derived from plant resources (i.e., biomass) are receiving attention recently.

In attempting to use polymers derived from plant resources as a binder resin, JP 2909873 discloses a toner including a polylactic acid as a binder resin. However, since polylactic acids have ester groups at a higher concentration compared to polyester resins, the polylactic resin has too high a thermal property to serve as a thermoplastic resin when the toner is fixed. In addition, because of having too high a hardness, the polylactic resin cannot be used for pulverized toners.

Published unexamined Japanese Patent Application No. (hereinafter referred to as JP-A) 9-274335 discloses a toner including a polyester resin formed by a dehydration polycondensation reaction between a lactic acid and an oxycarboxylic acid having 3 or more functional groups. However, since the polyester resin formed by a dehydrate polycondensation reaction between an alcohol group of the lactic acid and carboxyl group of the oxycarboxylic acid has high molecular weight, sharply-melting property and low temperature fixability of the toner deteriorate.

JP-A 2001-166537 discloses a toner including a polylactic acid-type biodegradable resin, and a terpene phenol copolymer as a low-molecular-weight constituent. However, this toner does not have a good combination of low temperature fixability and hot offset resistance.

As mentioned above, a toner using a polylactic acid resin does not still come into practical use.

SUMMARY OF THE INVENTION

Accordingly, an object of the present invention is to provide a toner and a developer having a good combination of the following properties:

(1) producing highly transparent images;

(2) low temperature fixability; and (3) hot offset resistance.

Another object of the present invention is to provide an image forming method which can produce high quality images having good color reproducibility.

Another object of the present invention is to provide a toner container which can contain the above toner for use in an image forming apparatus.

These and other objects of the present invention, either individually or in combinations thereof, as hereinafter will become more readily apparent can be attained by a toner, manufactured by a method comprising:

dispersing toner constituents including a resin, in an aqueous medium containing a particulate resin, wherein the resin comprises a polyester skeleton formed by a ring-opening addition reaction of a cyclic ester with a first compound having an active hydrogen group; and a developer and an image forming method using the above toner and a toner container containing the above toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1A:
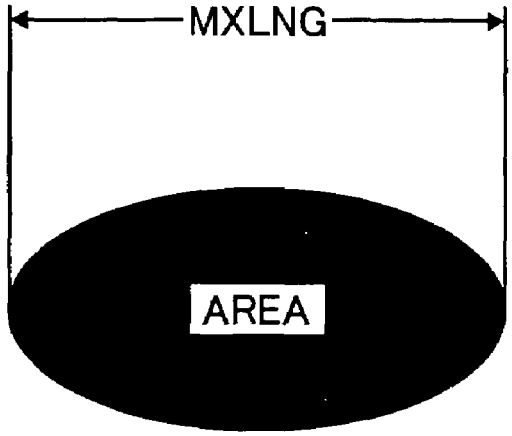
FIGS. 1A and 1B are schematic views for explaining how to determine the shape factors SF-1 and SF-2.

Generally, the present invention provides a toner including a resin having at least a polyester skeleton. The resin having at least a polyester skeleton is hereinafter referred to as a "polyester-type resin".

The first preferred embodiment of the toner of the present invention is obtainable by the following methods including:

dissolving or dispersing toner constituents including a polyester-type resin in an organic solvent to prepare a toner constituent mixture liquid;

emulsifying the toner constituent mixture liquid in an aqueous medium including a particulate resin to prepare a dispersion including toner particles; and removing the organic solvent from the dispersion;

washing to remove excess particulate resin adhered to the surface of the toner particles.

The polyester-type resin includes a polyester skeleton formed by a ring-opening addition reaction of a cyclic ester with a first compound having an active hydrogen group.

The second preferred embodiment of the toner of the present invention is obtainable by the following methods including:

dissolving or dispersing toner constituents including a polyester-type resin and a precursor of a polyester-type resin in an organic solvent to prepare a toner constituent mixture liquid;

emulsifying the toner constituent mixture liquid in an aqueous medium including a particulate resin, and subjecting the precursor of a polyester-type resin to an elongation reaction, to prepare a dispersion including toner particles; and removing the organic solvent from the dispersion;

washing to remove excess particulate resin adhered to the surface of the toner particles.

The polyester-type resin and/or the precursor of a polyester-type resin include a polyester skeleton formed by a ring-opening addition reaction of a cyclic ester with a first compound having an active hydrogen group.

The above toner constituents can include a colorant, a release agent, a charge controlling agent, etc. (these will be explained later) other than the polyester-type resin (and the precursor of a polyester-type resin).

We have found out that a toner including a polyester-type resin (and a precursor of a polyester-type resin) having a polyester skeleton formed by a ring-opening addition reaction of a cyclic ester with a first compound having an active hydrogen group, as a binder resin, can produce highly transparent images.

The polyester resin formed by a ring-opening addition reaction of a cyclic ester typically imparts high transparency to the resultant toner compared to a polyester resin having a bisphenol A skeleton or a polyester resin formed by aliphatic alcohols that are used in conventional toners. In addition, since such polyester resins include ester groups in high concentration, the resultant toner has relatively high polarity.

On the other hand, the above-mentioned particulate resin (included in the aqueous medium) also has relatively high polarity. For this reason, the toner and the particulate resin remaining on the surface of the toner particles have high compatibility, and therefore the light scattering that can occur at the interfaces between toner particles in the fixed toner layer can be prevented and a transparent toner layer can be obtained.

The precursor of a polyester-type resin may be used to improve offset resistance of the toner. When the precursor of a polyester-type resin includes a polyester skeleton formed by a ring-opening addition reaction of a cyclic ester, the precursor has high compatibility with both the (unmodified) polyester-type resin and the particulate resin. As a result, the resultant toner can produce images having high transparency, while having a good offset resistance.

Particulate Resin

Any known resins capable of forming an aqueous dispersion thereof can be used for the particulate resin of the present invention, and are not particularly limited. Both thermoplastic resins and thermosetting resins can be used. Specific examples of the resins for use in the particulate resin include, but are not limited to, vinyl resins, polyurethane resins, epoxy resins, polyester resins, polyamide resins, polyimide resins, silicon resins, phenol resins, melamine resins, urea resins, aniline resins, ionomer resins, polycarbonate resins, etc. These resins can be used alone or in combination. Among these resins, vinyl resins, polyurethane resins, epoxy resins, polyester resins, and mixtures thereof are preferably used because these resins can easily form an aqueous dispersion of fine particles thereof.

These particularly suitable resins (vinyl resins, polyurethane resins, epoxy resins, and polyester resins) will be explained in detail.

Vinyl Resin

The vinyl resin is especially suitable for use in the particulate resin. The vinyl resin can be formed by polymerization of a vinyl monomer or a copolymerization of vinyl monomers. Any known catalysts can be used in the polymerization.

Specific examples of the vinyl monomers are shown as follows.

(1) Vinyl Hydrocarbons:

(1-1) Aliphatic Vinyl Hydrocarbons;

Alkenes having 2 to 12 carbon atoms (e.g., ethylene, propylene, butene, isobutylene, pentene, heptene, diisobutylene, octene, dodecene, octadecene, α-olefins having 3 to 24 carbon atoms), alkadienes having 4 to 12 carbon atoms (e.g., butadiene, isoprene, 1,4-pentadiene, 1,6-hexadiene), etc.

(1-2) Alicyclic Vinyl Hydrocarbons;

Cycloalkenes or dicycloalkenes having 6 to 15 carbon atoms (e.g., cyclohexene, vinylcyclohexene, ethylidenebicycloheptene), cycloalkadienes or dicycloalkadienes having 5 to 12 carbon atoms (e.g., (di)cyclopentadiene), terpenes (e.g., pinene, limonene, indene), etc.

(1-3) Aromatic Vinyl Hydrocarbons;

Styrenes, hydrocarbyl (such as alkyl having 1 to 24 carbon atoms, cycloalkyl, aralkyl and/or alkenyl) substitution products of styrenes (e.g., α-methylstyrene, vinyltoluene, 2,4-dimethylstyrene, ethylstyrene, butylstyrene, phenylstyrene, cyclohexylstyrene, benzylstyrene, crotylbenzene, divinylbenzene), vinylnaphthalene, etc.

(2) Vinyl Monomers Including Carboxyl Group and Salts Thereof:

Unsaturated monocarboxylic acids having 3 to 30 carbon atoms (e.g., (meth)acrylic acid, crotonic acid, isocrotonic acid, cinnamic acid), unsaturated dicarboxylic acids having 3 to 30 carbon atoms or anhydrides thereof (e.g., maleic acid, maleic anhydride, fumaric acid, itaconic acid, citraconic acid, citraconic anhydride, mesaconic acid), monoalkyl (having 1 to 24 carbon atoms) esters of unsaturated dicarboxylic acids having 3 to 30 carbon atoms (e.g., monomethyl maleate, monooctadecyl maleate, monoethyl fumarate, monobutyl itaconates), etc.

The salts of the vinyl monomers having carboxyl group include, but are not limited to, alkali metal salts (e.g., sodium salts, potassium salts), alkaline-earth metal salts (e.g., calcium salts, magnesium salts), ammonium salts, amine salts, and quaternary ammonium salts. The amine salts include, but are not limited to, primary amine salts (e.g., ethylamine salts, butylamine salts, octylamine salts), secondary amine salts (e.g., diethylamine salts, dibutylamine salts), and tertiary amine salts (e.g., triethylamine salts, tributylamine salts). The quaternary ammonium salts include, but are not limited to, tetraethylammonium salts, triethyllaurylammonium salts, etc.

Specific preferred examples of the salts of the vinyl monomers having carboxyl group include sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, aluminum acrylate, etc.

(3) Vinyl Monomers Including Sulfo Group and Salts Thereof:

Alkene sulfonic acids having 2 to 14 carbon atoms (e.g., vinyl sulfonic acid, (meth)acrylic sulfonic acid, methyl vinyl sulfonic acid), styrene sulfonic acids and alkyl (having 2 to 24 carbon atoms) derivatives thereof (e.g., α-methylstyrene sulfonic acid), sulfo(hydroxy)alkyl (meth)acrylates having 5 to 18 carbon atoms (e.g., sulfopropyl (meth)acrylate, 2-hydroxy-3-(meth)acryloxypropyl sulfonic acid), sulfo(hydroxy)alkyl (meth)acrylamides having 5 to 18 carbon atoms (e.g., 2-(meth)acryloylamino-2,2-dimethylethane sulfonic acid, 2-(meth)acrylamide-2-methylpropane sulfonic acid), alkyl (having 3 to 18 carbon atoms) allylsulfo succinic acids (e.g., propyl allylsulfo succinic acid, butyl allylsulfo succinic acid), polyoxyalkylenes including 2 to 30 repeating units (e.g., homopolymers, random copolymers, and block copolymers of oxyethylene, oxypropylene, oxybutylene), sulfuric acid esters of mono(meth)acrylates (e.g., sulfuric acid esters of polyoxyethylene monomethacrylate including 5 to 15 repeating units), the following compounds (1-1) to (1-3):

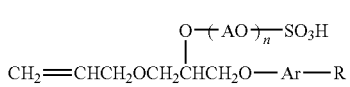

(1-1)

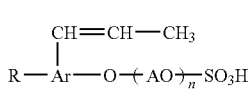

(1-2)

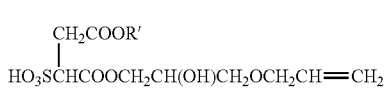

(1-3)

wherein R represents an alkyl group having 1 to 15 carbon atoms, A represents an alkylene group having 2 to 4 carbon atoms, Ar represents a benzene ring, R' represents an alkyl group having 1 to 15 carbon atoms which can be substituted by a fluorine atom, and n represents an integer of from 1 to 50;

and salts of the above compounds, etc.

The salts include, but are not limited to, counter ions of the compounds described in the above paragraph (2) Vinyl monomers having carboxyl group and salts thereof.

(4) Vinyl Monomers Including Phosphate Group and Salts Thereof:

Monoesters of (meth)acryloyloxyalkyl phosphoric acid (alkyl group has 1 to 24 carbon atoms) (e.g., 2-hydoxyethyl (meth)acryloyl phosphate, phenyl-2-acryloyloxyethyl phosphate), (meth)acryloyloxyalkyl phosphonic acids (alkyl group has 1 to 24 carbon atoms) (e.g., 2-acryloyloxyethyl phosphonic acid), etc.

The salts include, but are not limited to, counter ions of the compounds described in the above paragraph (2) Vinyl monomers having carboxyl group and salts thereof.

(5) Vinyl Monomers Including Hydroxyl Group:

Hydroxystyrene, N-methylol (meth)acrylamide, hydroxyethyl (meth)acrylate, hydroxypropyl (meth)acrylate, polyethylene glycol mono(meth)acrylate, (meth)allyl alcohol, crotyl alcohol, isocrotyl alcohol, 1-butene-3-ol, propargyl alcohol, 2-hydroxyethyl propenyl ether, sucrose allyl ether, etc.

(6) Vinyl Monomers Including Nitrogen:

(6-1) Vinyl Monomers Including Amino Group;

Aminoethyl (meth)acrylate, dimethylaminoethyl (meth) acrylate, diethylaminoethyl (meth)acrylate, t-butylaminoethyl (meth)acrylate, N-aminoethyl (meth)acrylamide, (meth)allylamine, morpholinoethyl (meth)acrylate, 4-vinylpyridine, 2-vinylpyridine, crotylamine, N,N-dimethylaminostyrene, methyl α-acetoamino acrylate, vinylimidazole, N-vinylpyrrol, N-vinylthiopyrrolidone, N-arylphenylenediamine, aminocarbazole, etc.;

and salts thereof.

(6-2) Vinyl Monomers Including Amide Group;

(Meth)acrylamide, N-methyl (meth)acrylamide, N-butyl acrylamide, diacetone acrylamide, N-methylol (meth) acrylamide, N,N'-methylene bis(meth)acrylamide, cinnamic acid amide, N,N-dimethyl acrylamide, etc.

(6-3) Vinyl Monomers Including Nitrile Group Having 3 to 10 Carbon Atoms;

(Meth)acrylonitrile, cyanostyrene, cyanoacrylate, etc.

(6-4) Vinyl Monomers Including Quaternary Ammonium Cation Group;

Quaternary compounds (produced by using quaternate agent such as methyl chloride, dimethyl sulfuric acid, benzyl chloride, dimethyl carbonate, etc.) of vinyl monomers including tertiary amine group (such as dimethylaminoethyl (meth)acrylate, diethylaminoethyl (meth)acrylate, dimethylaminoethyl (meth)acrylamide, diethylaminoethyl (meth)acrylamide) (e.g., dimethyl diallyl ammonium chloride, trimethyl allyl ammonium chloride, etc.).

(6-5) Vinyl Monomers Including Nitro Group Having 8 to 12 Carbon Atoms;

Nitrostyrene, etc.

(7) Vinyl Monomers Including Epoxy Group Having 6 to 18 Carbon Atoms:

Glycidyl (meth)acrylate, tetrahydrofurfuryl (meth)acrylate, p-vinylphenylphenyloxide, etc.

(8) Vinyl Monomers Including Halogen Group Having 2 to 16 Carbon Atoms:

Vinyl chloride, vinyl bromide, vinylidene chloride, allyl chloride, chlorostyrene, bromostyrene, dichlorostyrene, chloromethylstyrene, tetrafluorostyrene, chloroprene, etc.

(9) Vinyl Esters, Vinyl (Thio)Ethers, Vinyl Ketones, and Vinyl Sulfones:

(9-1) Vinyl Esters Having 4 to 16 Carbon Atoms;

Vinyl acetate, vinyl propionate, vinyl butyrate, diallyl phthalate, diallyl adipate, isopropenyl acetate, vinyl methacrylate, cyclohexyl methacrylate, benzyl methacrylate, phenyl (meth)acrylate, vinylmethoxy acetate, vinyl benzoate, alkyl (meth)acrylates having 1 to 50 carbon atoms (e.g., methyl (meth)acrylate, ethyl (meth)acrylate, butyl (meth) acrylate, dodecyl (meth)acrylate, heptadecyl (meth)acrylate), dialkyl fumarates (2 alkyl groups are straight-chain type or branched-chain type or alicyclic type, having 2 to 8 carbon atoms), dialkyl maleates (2 alkyl groups are strait-chain type or branched-chain type or alicyclic type, having 2 to 8 carbon atoms), poly(meth)allyloxyalkanes (e.g., diallyloxyethane, triallyloxyethane, tetraallyloxypropane), vinyl monomers including polyalkyleneglycol chain (e.g., polyethyleneglycol (weight average molecular weight (Mw) of 300) mono(meth)acrylate, polypropyleneglycol (Mw of 500) monoacrylate, methyl alcohol ethylene oxide (EO) 10 mol adduct of (meth)acrylate, lauryl alcohol EO 30 mol adduct of (meth)acrylate), poly(meth) acrylates (e.g., poly(meth)acrylates of polyols such as ethylene glycol di(meth)acrylate, propylene glycol di(meth) acrylate, polyethylene glycol di(meth)acrylate), etc.

(9-2) Vinyl (Thio)Ethers Having 3 to 16 Carbon Atoms;

Vinyl methyl ether, vinyl ethyl ether, vinyl butyl ether, vinyl 2-ethyl-hexyl ether, vinyl phenyl ether, vinyl 2-methoxyethyl ether, methoxybutadiene, phenoxystyrene, etc.

(9-3) Vinyl Ketones Having 4 to 12 Carbon Atoms;

Vinyl methyl ketone, vinyl ethyl ketone, vinyl phenyl ketone, etc.

(9-4) Vinyl Sulfones Having 2 to 16 Carbon Atoms;

Divinyl sulfide, p-vinyl diphenyl sulfide, vinyl ethyl sulfide, vinyl ethyl sulfone, divinyl sulfone, divinyl sulfoxide, etc.

(10) Other Vinyl Monomers:

Isocyanatethyl (meth)acrylate, m-isopropenyl-α,α-dimethylbenzyl isocyanate, etc.

The vinyl resin for use in the present invention includes copolymers obtained by copolymerizing any 2 or more vinyl monomers described in the above paragraphs (1) to (10) at a random ratio. Specific examples of such copolymers include styrene-(meth)acrylate copolymer, styrene-butadiene copolymer, (meth)acrylic acid-(meth)acrylate copolymer, styrene-acrylonitrile copolymer, styrene-maleic anhydride copolymer, styrene-(meth)acrylic acid copolymer, styrene-(meth)acrylic acid-divinylbenzene copolymer, styrene-styrene sulfonic acid-(meth)acrylate copolymer, etc.

When a toner is prepared by a dissolution suspension method, a resin for preparing the above-mentioned particulate resin has to be capable of forming an aqueous dispersion of fine particles thereof. The resin has to be insoluble in water under the conditions in which the toner particle dispersion is formed (typically from 5 to 90° C.). For this reason, when the vinyl resin is a copolymer resin formed by a hydrophobic monomer and a hydrophilic monomer, the vinyl resin preferably includes the hydrophobic monomer in an amount of not less than 10% by weight, and more preferably not less than 30% by weight. When the amount of the hydrophobic resin is too small, the vinyl resin tends to be dissolved in water, and therefore the resultant toner has a wide particle diameter distribution.

The hydrophilic monomer is defined as a monomer in which the solubility in water at 25° C. is at least 100 g of the monomer dissolved in 100 g of water. In contrast, the hydrophobic monomer is defined as a monomer in which the solubility in water at 25° C. is less than 100 g of the monomer dissolved in 100 g of water.

Polyester Resin

Specific examples of the polyester resins for use in the particulate resin include polycondensation products of a polyol with a polycarboxylic acid or its acid anhydride or its lower alkyl ester, addition polymerization products of a first compound (m) having an active hydrogen group and a cyclic ester (n) (these will be explained later), etc.

Specific examples of the polyols include diols (11) and polyols (12) having 3 or more valences.

Specific examples of the polycarboxylic acids and their acid anhydrides and their lower alkyl esters include dicarboxylic acids (13) and polycarboxylic acids (14) having 3 or more valences, and their acid anhydrides and their lower alkyl esters.

When a polyester is formed by a polycondensation reaction, a polyol and a polycarboxylic acid are mixed such that the equivalent ratio ([OH]/[COOH]) between a hydroxyl group [OH] and a carboxyl group [COOH] is preferably from 2/1 to 1/1, more preferably from 1.5/1 to 1/1, and much more preferably from 1.3/1 to 1.02/1.

Specific examples of the diols (11) include, but are not limited to, alkylene glycols having 2 to 30 carbon atoms (e.g., ethylene glycol, 1,2-propylene glycol, 1,3-propylene glycol, 1,4-butanediol, 1,6-hexanediol, octanediol, decanediol, dodecanediol, tetradecanediol, neopentyl glycol, 2,2-diethyl-1,3-propanediol), alkylene ether glycols having Mw of from 100 to 10000 (e.g., diethylene glycol, triethylene glycol, dipropylene glycol, polyethylene glycol, polypropylene glycol, polytetramethylene ether glycol), alicyclic diols having 6 to 24 carbon atoms (e.g., 1,4-cyclohexanedimethanol, hydrogenated bisphenol A), alkylene oxide (AO) (such as ethylene oxide (EO), propylene oxide (PO), butylene oxide (BO)) adducts (2 to 100 mol) of the above alicyclic diols having Mw of from 100 to 10000 (e.g., EO 10 mol adduct of 1,4-cyclohexanedimethanol), AO (such as EO, PO, BO) adducts (2 to 100 mol) of bisphenols having 15 to 30 carbon atoms (such as bisphenol A, bisphenol F, bisphenol S) or polyphenols having 12 to 24 carbon atoms (such as catechol, hydroquinone, resorcin) (e.g., EO 2 to 4 mol adducts of bisphenol A, PO 2 to 4 mol adducts of bisphenol A), polylactonediols having Mw of from 100 to 5000 (e.g., poly(ε-caprolactonediol)), polybutadienediol having Mw of from 1000 to 20000, etc.

Among these, alkylene glycols and AO adducts of bisphenols are preferably used, and (1) AO adducts of bisphenols and (2) a mixture of AO adducts of bisphenols and alkylene glycols are more preferably used.

Specific examples of the polyols (12) having 3 or more valences include, but are not limited to, aliphatic polyols having 3 to 8 carbon atoms (e.g., glycerin, trimethylolethane, trimethylolpropane, pentaerythritol, sorbitan, sorbitol), AO (having 2 to 4 carbon atoms) adducts (2 to 100 mol) of trisphenols (such as trisphenol PA) having 25 to 50 carbon atoms (e.g., EO 2 to 4 mol adducts of trisphenol PA, PO 2 to 4 mol adducts of trisphenol PA), AO (having 2 to 4 carbon atoms) adducts (2 to 100 mol) of novolac resins (such as phenol novolac, cresol novolac) having polymerization degree of from 3 to 50 (e.g., PO 2 mol adduct of phenol novolac, EO 4 mol adduct of phenol novolac), AO (having 2 to 4 carbon atoms) adducts (2 to 100 mol) of polyphenols (such as pyrogallol, phloroglucinol, 1,2,4-benzenetriol) having 6 to 30 carbon atoms (e.g., EO 4 mol adduct of pyrogallol), acryl polyols having polymerization degree of from 20 to 2000 (e.g., copolymers of hydroxyethyl (meth)acrylates and other vinyl monomers such as styrene, (meth)acrylic acid, (meth)acrylate), etc.

Among these, aliphatic polyols and AO adducts of novolac resins are preferably used, and AO adducts of novolac resins are more preferably used.

Specific examples of the dicarboxylic acids (13) include, but are note limited to, alkanedicarboxylic acids having 4 to 32 carbon atoms (e.g., succinic acid, adipic acid, sebacic acid, azelaic acid, dodecanedicarboxylic acid, octadecanedicarboxylic acid), alkenedicarboxylic acids having 4 to 32 carbon atoms (e.g., maleic acid, fumaric acid, citraconic acid, mesaconic acid), branched alkenedicarboxylic acids having 8 to 40 carbon atoms (e.g., dimmer acid, alkenylsuccinic acid such as dodecenylsuccinic acid, pentadecenylsuccinic acid, octadecenylsuccinic acid), branched alkanedicarboxylic acids having 12 to 40 carbon atoms (e.g., alkylsuccinic acid such as decylsuccinic acid, dodecylsuccinic acid, octadecylsuccinic acid), aromatic dicarboxylic acids having 8 to 20 carbon atoms (e.g., phthalic acid, isophthalic acid, terephthalic acid, naphthalenedicarboxylic acid), etc.

Among these, alkenedicarboxylic acids and aromatic dicarboxylic acids are preferably used, and aromatic dicarboxylic acids are more preferably used.

Specific examples of the polycarboxylic acids (14) having 3 or more valences include, but are not limited to, aromatic polycarboxylic acids (e.g., trimellitic acid, pyromellitic acid), etc.

Specific examples of the acid anhydrides of the dicarboxylic acids (13) and the polycarboxylic acids (14) having 3 or more valences include, but are not limited to, trimellitic acid anhydride, pyromellitic acid anhydride, etc. Specific examples of the lower alkyl esters of the dicarboxylic acids (13) and the polycarboxylic acids (14) having 3 or more valences include, but are not limited to, methyl ester, ethyl ester, isopropyl ester, etc.

Polyurethane Resin

Specific examples of the polyurethane resins for use in the particulate resin include, but are not limited to, polyaddition products of polyisocyanates (15) and compounds (D) having an active hydrogen group (e.g., water, diols (11), polyols (12) having 3 or more valences, dicarboxylic acids (13), polycarboxylic acids (14) having 3 or more valences, polyamines (16), polythiols (17)), etc.

Any known catalysts can be used for a polyaddition reaction.

Specific examples of the polyisocyanates (15) include, but are not limited to, aromatic polyisocyanates having 6 to 20 carbon atoms (hereinafter excluding carbon atoms in NCO group), aliphatic polyisocyanates having 2 to 18 carbon atoms, alicyclic polyisocyanates having 4 to 15 carbon atoms, aromatic aliphatic polyisocyanates having 8 to 15 carbon atoms, modified polyisocyanates (e.g., modified polyisocyanates having urethane group, carbodiimide group, allophanate group, urea group, biuret group, urethodione group, urethoimine group, isocyanurate group, oxazolidone group, etc.), etc.; and mixtures of two or more thereof.

Specific examples of the aromatic polyisocyanates include, but are not limited to, 1,3- or 1,4-phenylene isocyanate, 2,4- or 2,6-tolylene diisocyanate (TDI), crude TDI, 2,4'- or 4,4'- diphenylmethane diisocyanate (MDI), crude MDI (i.e., phosgene compounds of crude di(aminophenyl)methane (i.e., condensation products of formaldehyde with aromatic amine or aniline or these mixture; and mixtures of di(aminophenyl) methane and a little amount (for example, 5 to 20%) of polyamine having 3 or more reactive groups); and polyallyl polyisocyanate (PAPI)), 1,5-naphthylene diisocyanate, 4,4',4"-triphenylmethane triisocyanate, m- or p-isocyanatophenylsulfonyl isocyanate, etc.; and mixtures of two or more thereof.

Specific examples of the aliphatic polyisocyanates include, but are not limited to, ethylene diisocyanate, tetramethylene diisocyanate, hexamethylene diisocynate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, 2-isocyanatoethyl-2,6-diisocyanatohexanoate, etc.; and mixtures of two or more thereof.

Specific examples of the alicyclic polyisocyanates include, but are not limited to, isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, 2,6-norbornane diisocyanate, etc.; and mixtures of two or more thereof.

Specific examples of the aromatic aliphatic polyisocyanates include, but are not limited to, m-xylylene diisocyanate and p-xylylene diisocyanate (XDI), $\alpha,\alpha,\alpha',\alpha'$-tetramethylxylylene diisocyanate (TMXDI), etc.; and mixtures of two or more thereof.

Specific examples of the modified polyisocyanates having urethane group, carbodiimide group, allophanate group, urea group, biuret group, urethodione group, urethoimine group, isocyanurate group, and oxazolidone group include, but are not limited to, modified MDI (e.g., urethane-modified MDI, carbodiimide-modified MDI, trihydrocarbylphosphate-modified MD), urethane-modified TDI, etc.; and mixtures of two or more thereof (e.g., mixture of modified MDI and urethane-modified TDI).

Among these, aromatic polyisocyanates, aliphatic polyisocyanates, and alicyclic polyisocyanates are preferably used, and TDI, MDI, HDI, hydrogenated MDI, and IPDI are more preferably used.

Specific examples of the polyamines (16) include, but are not limited to, aliphatic polyamines having 2 to 18 carbon atoms, aromatic polyamines having 6 to 20 carbon atoms, etc.

Specific examples of the aliphatic polyamines having 2 to 18 carbon atoms include, but are not limited to, aliphatic polyamines; alkyl (having 1 to 4 carbon atoms) or hydroxyalkyl (having 2 to 4 carbon atoms) substitutes of aliphatic polyamines; alicyclic polyamines and aliphatic polyamines having a heterocyclic ring; aliphatic polyamines having an aromatic ring (having 8 to 15 carbon atoms); etc.

Specific examples of the aliphatic polyamines include, but are not limited to, alkylene diamines having 2 to 12 carbon atoms (e.g., ethylene diamine, propylene diamine, trimethylene diamine, tetramethylene diamine, hexamethylene diamine), polyalkylene (having 2 to 6 carbon atoms) polyamines (e.g., diethylene triamine, iminobispropyl amine, bis(hexamethylene) triamine, triethylene tetramine, pentaethylene hexamine), etc.

Specific examples of the alkyl (having 1 to 4 carbon atoms) or hydroxyalkyl (having 2 to 4 carbon atoms) substitutes of aliphatic polyamines include, but are not limited to, dialkyl (having 1 to 3 carbon atoms) aminopropyl amine, trimethylhexamethylene diamine, aminoethylethanol amine, 2,5-dimethyl-2,5-hexamethylene diamine, methyliminobispropyl amine, etc.

Specific examples of the alicyclic polyamines and aliphatic polyamines having a heterocyclic ring include, but are not limited to, alicyclic polyamines having 4 to 15 carbon atoms (e.g., 1,3-diaminocyclohexane, isophorone diamine, menthene diamine, 4,4'-methylenedicyclohexane diamine (hydrogenated methylene dianiline), 3,9-bis(3-aminopropyl)-2,4,8,10-tetraoxaspiro[5,5]undecane), aliphatic polyamines having a heterocyclic ring having 4 to 15 carbon atoms (e.g., piperazine, N-aminoethylpiperazine, 1,4-diaminoethylpiperazine, 1,4-bis(2-amino-2-methylpropyl)piperazine), etc.

Specific examples of the aliphatic polyamines having an aromatic ring (having 8 to 15 carbon atoms) include, but are not limited to, xylylene diamine, tetrachloro-p-xylylene diamine, etc.

Specific examples of the aromatic polyamines (having 6 to 20 carbon atoms) include, but are not limited to, unsubstituted aromatic polyamines, aromatic polyamines having nuclear substitutive alkyl groups (having 1 to 4 carbon atoms such as methyl group, ethyl group, n-propyl or i-propyl group, butyl group), aromatic polyamines having nuclear substitutive electron attractive groups (e.g., halogen groups such as chloro group, bromo group, iodic group, and fluoro group; alkoxy groups such as methoxy group and ethoxy group; and nitro group), aromatic polyamines having a secondary amino group, etc.

Specific examples of the unsubstituted aromatic polyamines include, but are not limited to, 1,2-phenylene diamine and 1,3-phenylene diamine and 1,4-phenylene diamine, 2,4'-diphenylmethane diamine and 4,4'-diphenylmethane diamine, crude diphenylmethane diamine (polyphenylpolymethylenepolyamine), diaminodiphenyl sulfone, benzidine, thiodianiline, bis(3,4-diaminophenyl) sulfone, 2,6-diaminopyridine, m-aminobenzyl amine, triphenylmethane-4,4'-4"-triamine, naphthylene diamine, etc.; and mixtures of two or more thereof.

Specific examples of the aromatic polyamines having nuclear substitutive alkyl groups include, but are not limited to, 2,4-tolylene diamine and 2,6-tolylene diamine, crude tolylene diamine, diethyl tolylene diamine, 4,4'-diamino-3,3'-dimethyldiphenylmethane, 4,4'-bis(o-toluidine), dianisidine, 1,3-dimethyl-2,4-diaminobenzene, etc.; and mixtures of two or more thereof.

Specific examples of the aromatic polyamines having nuclear substitutive electron attractive groups include, but are not limited to, methylenebis(o-chloroaniline), 4-chloro-o-phenylene diamine, 2-chloro-1,4-phenylene diamine, 3-amino-4-chloroaniline, 4-bromo-1,3-phenylene diamine, etc.

Specific examples of the aromatic polyamines having a secondary amino group include, but are not limited to, substitutes of the above-mentioned aromatic polyamines in which a part of or all of the primary amino groups are substituted with a secondary amino group (—NHR': wherein R' represents an alkyl group such as lower alkyl groups having 1 to 4 carbon atoms such as methyl group and ethyl group) (e.g., 4,4'-di(methylamino)diphenylmethane, 1-methyl-2-methylamino-4-aminobenzene), polyamidepolyamines (e.g., low-molecular-weight polyamidepolyamine formed by polycondensation of dicarboxylic acid (such as dimer acid) and excessive (not less than 2 mol per 1 mol of carboxylic acid) polyamine (such as alkylene diamine and polyalkylenepolyamine)), polyetherpolyamine (e.g., hydrides of cyanoethylated polyetherpolyol (such as polyalkylene glycol)), etc.

Specific examples of the polythiols (17) include, but are not limited to, dithiol having 2 to 24 carbon atoms, polythiols having 3 or more valences and having 5 to 30 carbon atoms.

Specific examples of the dithiols include, but are not limited to, ethylenedithiol, 1,4-butanedithiol, 1,6-hexanedithiol, etc.

Specific examples of the polythiols include, but are not limited to, CAPCURE 3800 (from Japan Epoxy Resins Co., Ltd.), polyvinylthiol, etc.

Among the compounds (D) having an active hydrogen group, water, diols (11), polyols (12), dicarboxylic acids (13), and polyamines (16) are preferably used, water, diols (11), polyols (12), and polyamines (16) are more preferably used, and diols (11), polyols (12), and polyamines (16) are much more preferably used.

Epoxy Resin

Specific examples of the epoxy resins for use in the particulate resin include, but are not limited to, ring-opening polymerization products of polyepoxides (18), polyaddition products of polyepoxides (18) and compounds (D) having an active hydrogen group (e.g., water, diols (11), polyols (12) having 3 or more valences, dicarboxylic acids (13), polycarboxylic acids (14) having 3 or more valences, polyamines (16), polythiols (17)), cured products of polyepoxides (18) with anhydrides of dicarboxylic acids (13) or polycarboxylic acids (14) having 3 or more valences, etc.

The polyepoxides (18) for use in the present invention include 2 or more epoxy groups per molecule, and not particularly limited. From the viewpoint of mechanical strength of the cured products, polyepoxides having 2 to 6 epoxy group per molecule are preferably used. The polyepoxide (18) preferably has an epoxy equivalent (i.e., molecular weight of the polyepoxide (18) per epoxy group) of from 65 to 1000 g/equivalent, and preferably 90 to 500 g/equivalent. When the epoxy equivalent is too large, the cured product has loose cross-linking structure, resulting in deterioration of water resistance, chemical resistance, mechanical strength, etc. thereof. In contrast, polyepoxides having too small the epoxy equivalent are difficult to be synthesized.

Specific examples of the polyepoxides (18) include, but are not limited to, aromatic polyepoxy compounds, heterocyclic polyepoxy compounds, alicyclic polyepoxy compounds, aliphatic polyepoxy compounds, etc.

Specific examples of the aromatic polyepoxy compounds include, but are not limited to, glycidyl ethers and glycidyl esters of polyphenols, glycidyl aromatic polyamines, glycidyl compounds of aminophenols, etc.

Specific examples of the glycidyl ethers of polyphenols include, but are not limited to, bisphenol F diglycidyl ether, bisphenol B diglycidyl ether, bisphenol AD diglycidyl ether, bisphenol S diglycidyl ether, halogenated bisphenol A diglycidyl, resorcinol diglycidyl ether, hydroquinone diglycidyl ether, pyrogallol triglycidyl ether, dihydroxybiphenyl diglycidyl ether, tris(hydroxyphenyl)methane triglycidyl ether, dinaphthyltriol triglycidyl ether, bis(hydroxynaphthalene) tetraglycidyl ether, diglycidyl ether of phenol or cresol novolac resin, diglycidyl ether formed by a reaction between 2 mol of bisphenol A and 3 mol of epichlorohydrin, polyglycidyl ether of polyphenol formed by a condensation reaction between phenol, and glyoxal or gultaraldehyde or formaldehyde, polyglycidyl ether of polyphenol formed by a condensation reaction between resorcin and acetone, etc.

Specific examples of the glycidyl esters of polyphenols include, but are not limited to, diglycidyl phthalate, diglycidyl isophthalate, diglycidyl terephthalate, etc.

Specific examples of the glycidyl aromatic polyamines include, but are not limited to, N,N-diglycidylaniline, N,N,N',N'-tetraglycidylxylylene diamine, N,N,N',N'-tetraglycidyldiphenylmethane diamine, etc.

Specific examples of the aromatic polyepoxy compounds include, but are not limited to, (1) triglycidyl ether of p-aminophenol, (2) diglycidyl urethane compounds formed by an addition reaction between tolylene diisocyanate or diphenylmethane diisocyanate, and glycidol, (3) polyurethane (pre) polymer having glycidyl group formed by reacting a polyol to the reactants of the above (1) and (2), and (4) diglycidyl ether of AO (e.g., EO and PO) adducts of bisphenol A.

Specific examples of the heterocyclic polyepoxy compounds include, but are not limited to, trisglycidyl melamine, etc.

Specific examples of the alicyclic polyepoxy compounds include, but are not limited to, vinylcyclohexene dioxide, limonene dioxide, dicyclopentadiene dioxide, bis(2,3-epoxycyclopentyl) ether, ethylene glycol bisepoxydicyclopentyl ether, bis(3,4-epoxy-6-methylcyclohexylmethyl)butylamine, diglycidyl ester of dimer acid, etc. In addition, the alicyclic polyepoxy compounds include nuclear-hydrogenated aromatic polyepoxy compounds.

Specific examples of the aliphatic polyepoxy compounds include, but are not limited to, polyglycidyl ethers of polyaliphatic alcohols, polyglycidyl esters of polyfatty acids, and glycidyl aliphatic amines.

Specific examples of the polyglycidyl ethers of polyaliphatic alcohols include, but are not limited to, ethylene glycol diglycidyl ether, propylene glycol diglycidyl ether, tetramethylene glycol diglycidyl ether, 1,6-hexanediol diglycidyl ether, polyethylene glycol diglycidyl ether, polypropylene glycol diglycidyl ether, polytetramethylene glycol diglycidyl ether, neopentyl glycol diglycidyl ether, trimethylolpropane polyglycidyl ether, glycerol polyglycidyl ether, pentaerythritol polyglycidyl ether, sorbitol polyglycidyl ether, polyglycerol polyglycidyl ether, etc.

Specific examples of the polyglycidyl esters of polyfatty acids include, but are not limited to, diglycidyl oxalate, diglycidyl maleate, diglycidyl succinate, diglycidyl glutarate, diglycidyl adipate, diglycidyl pimelate, etc.

Specific examples of the glycidyl aliphatic amines include, but are not limited to, N,N,N',N'-tetraglycidylhexamethylene diamine, etc.

In addition, the aliphatic polyepoxy compounds include, but are not limited to, diglycidyl ethers and (co)polymers of glycidyl (meth)acrylates.

Among these, the aliphatic polyepoxy compounds and the aromatic polyepoxy compounds are preferably used.

These polyepoxides can be used alone or in combination.

As mentioned above, the toner of the present invention is obtainable by dispersing a polyester-type resin or a solution of the polyester-type resin (and optionally a precursor of a polyester-type resin or a solution of the precursor of a polyester-type resin) in an aqueous medium including a particulate resin (and then optionally reacting the precursor of a polyester-type resin). When toner particles are formed, the particulate resin adsorbs to the surface of the toner particles so that each of the particles of the particulate resin or each of the toner particles are prevented from uniting with each other, and so that the toner particles are prevented from dividing even under application of high shear force. As a result, the toner particles have a narrow particle diameter distribution. The particulate resin preferably has the following properties:

(1) having a mechanical strength resistant to an application of a shear force at a temperature of dispersing;

(2) hardly dissolved or swelled in water; and (3) hardly dissolved or swelled in a polyester-type resin or a solution of the polyester-type resin (and optionally a precursor of a polyester-type resin or a solution of the precursor of a polyester-type resin).

The resin for use in the particulate resin typically has a glass transition temperature (Tg) of from 0 to 300° C., preferably from 20 to 250° C., and more preferably from 50 to 200° C., to improve particle diameter distribution, fluidity, thermostable preservability, and stress resistance of the toner. When the Tg is lower than a temperature at which an aqueous dispersion of the toner is formed, the particulate resin cannot prevent each of the particles of the particulate resin or each of the toner particles from uniting with each other, and cannot prevent the toner particles from dividing under application of high shear force. The Tg can be determined by the differential scanning calorimetry (DSC).

The particulate resin preferably has a Shore D hardness of not less than 30, and more preferably from 45 to 100. It is preferable that the particulate resin has the above hardness even after the particulate resin is soaked in water or an organic solvent for a predetermined time.

In order to control solubility and swelling property of the particulate resin in water or an organic solvent which is used in the dispersing process, the resin properties such as molecular weight, SP value (calculating method is disclosed in Polymer Engineering and Science, February, 1974, Vol. 14, No. 2, p. 147-154), crystallinity, molecular weight between crosslinks, etc. are preferably controlled as appropriate.

The resin for use in the particulate resin typically has a number average molecular weight (Mn) of from 200 to 5,000,000, and preferably from 2,000 to 500,000. The Mn can be determined by gel permeation chromatography (GPC).

The resin for use in the particulate resin preferably has an SP value of from 7 to 18, and more preferably from 8 to 14.

The resin for use in the particulate resin preferably has a melting point (measured by DSC) of not less than 50° C., and more preferably not less than 80° C.

In order to improve heat resistance, water resistance, chemical resistance, and uniformity of the particle diameter of the resultant toner, the resin used for the particulate resin may include a cross-linking structure. The cross-linking structure may be formed by covalent bond, coordinate bond, ionic bond, hydrogen bond, etc. When the resin includes a cross-linking structure, a molecular weight between crosslinks is preferably not less than 30, and more preferably not less than 50.

In contrast, when the particulate resin adhered to the toner particles is intended to be dissolved when an aqueous dispersion of the toner is formed, the resin used for the particulate resin preferably includes no cross-linking structure.

The methods for forming an aqueous dispersion of a particulate resin are as follows, but are not limited thereto:

(1) When the resin is a vinyl resin, an aqueous dispersion of a particulate resin is directly formed by polymerization reaction (such as suspension polymerization, emulsion polymerization, seed polymerization, and dispersion polymerization) of monomers in an aqueous medium.

(2) When the resin is a polyaddition resin or a polycondensation resin such as polyester resin, polyurethane resin, and epoxy resin, a precursor of the resin (such as monomer and oligomer) or a solvent solution of the precursor is dispersed in an aqueous medium in the presence of a suitable dispersing agent, followed by heating or adding a curing agent so that an aqueous dispersion of a particulate resin is formed.

(3) When the resin is a polyaddition resin or a polycondensation resin such as polyester resin, polyurethane resin, and epoxy resin, a precursor of the resin (such as monomer and oligomer, preferably in liquid form, if not liquid, preferably liquefy by the application of heat) or a solvent solution of the precursor is phase-inversion emulsified by adding an aqueous medium after adding a suitable emulsifying agent thereto so that an aqueous dispersion of a particulate resin is formed.

(4) A resin formed by polymerization reaction (such as addition polymerization, ring-opening polymerization, condensation polymerization, addition condensation, etc.) is pulverized using a mechanical rotational type pulverizer or a jet type pulverizer, followed by classification, to prepare a particulate resin. The particulate resin is dispersed in an aqueous medium in the presence of a suitable dispersing agent so that an aqueous dispersion of the particulate resin is formed.

(5) A resin formed by polymerization reaction (such as addition polymerization, ring-opening polymerization, condensation polymerization, addition condensation, etc.) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(6) A resin formed by polymerization reaction (such as addition polymerization, ring-opening polymerization, condensation polymerization, addition condensation, etc.) is dissolved in a solvent to prepare a resin solution. Another solvent is added to the resin solution or the resin solution is subjected to cooling after heating, and then the solvent is removed so that a particulate resin separates out. The particulate resin is dispersed in an aqueous medium in the presence of a suitable dispersing agent so that an aqueous dispersion of the particulate resin is formed.

(7) A resin formed by polymerization reaction (such as addition polymerization, ring-opening polymerization, condensation polymerization, addition condensation, etc.) is dissolved in a solvent, and then the resin solution is dispersed in an aqueous medium in the presence of a suitable dispersing agent, followed by removal of the solvent, so that an aqueous dispersion of a particulate resin is formed.

(8) A resin formed by polymerization reaction (such as addition polymerization, ring-opening polymerization, condensation polymerization, addition condensation, etc.) is dissolved in a solvent, and then the resin solution is phase-inversion emulsified by adding an aqueous medium after adding a suitable emulsifying agent thereto so that an aqueous dispersion of a particulate resin is formed.

Specific examples of the above emulsifying agents and dispersing agents include any known surfactants (S), water-soluble polymers (T), etc. Specific examples of auxiliary agents for emulsification and dispersion include organic solvents (U), plasticizer (V), etc.

Specific examples of the surfactants (S) include, but are not limited to, anionic surfactants (S-1), cationic surfactants (S-2), amphoteric surfactants (S-3), nonionic surfactants (S-4), etc. The surfactants (S) can be a mixture of 2 or more surfactants.

Specific examples of the anionic surfactants (S-1) include, but are not limited to, carboxylic acids and their salts, salts of sulfuric acid esters, salts of carboxymethylated compounds, salts of sulfonic acids, salts of phosphoric acid esters, etc.

Specific examples of the carboxylic acids include, but are not limited to, saturated or unsaturated fatty acids having 8 to 22 carbon atoms (e.g., capric acid, lauric acid, myristic acid, palmitic acid, stearic acid, arachidic acid, behenic acid, oleic acid, linoleic acid, ricinoleic acid, and mixtures of higher fatty acids obtained by saponifying palm oil, palm kernel oil, rice bran oil, beef tallow oil, etc.). Specific examples of their salts include, but are not limited to, their sodium salts, potassium salts, ammonium salts, and alkanolamine salts.

Specific examples of salts of sulfuric acid esters include, but are not limited to, salts of sulfuric acid esters of higher alcohols (aliphatic alcohols having 8 to 18 carbon atoms), salts of sulfuric acid esters of higher alkyl ethers (EO 1 to 10 mol adducts of aliphatic alcohols having 8 to 18 carbon atoms), sulfated oils (neutralized products of sulfated natural unsaturated oils and fats or unsaturated waxes), sulfated fatty esters (neutralized products of sulfated lower alcohol ester of unsaturated fatty acids), and sulfated olefins (neutralized products of sulfated olefins having 12 to 18 carbon atoms). Specific examples of these salts include, but are not limited to, their sodium salts, potassium salts, ammonium salts, and alkanolamine salts.

Specific examples of the salts of sulfuric acid esters of higher alcohols include, but are not limited to, salts of sulfuric acid esters of octyl alcohol, salts of sulfuric acid esters of lauryl alcohol, salts of sulfuric acid esters of stearyl alcohol, salts of sulfuric acid esters of alcohols synthesized using Ziegler catalyst (e.g., ALFOL® 1214 from Condea Chemie GmbH), salts of sulfuric acid esters of alcohols synthesized by oxo process (e.g., DOVANOL® 23, 25, and 45 from Mitsubishi Petrochemical Co., Ltd., TRIDECANOL from Kyowa Hakko Co., Ltd., OXOCOL 1213, 1215, and 1415 from Nissan Chemical Industries, Ltd., DIADOL® 15-L, 115H, and 135 from Mitsubishi Kasei Corporation).

Specific examples of the salts of sulfuric acid esters of higher alkyl ethers include, but are not limited to, salts of sulfuric acid esters of EO 2 mol adduct of lauryl alcohol, salts of sulfuric acid esters of EO 3 mol adduct of octyl alcohol, etc.

Specific examples of the sulfated oils include, but are not limited to, sodium, potassium, ammonium, and alkanolamine salts of sulfated castor oil, olive oil, canola oil, beef tallow, etc.

Specific examples of the sulfated fatty esters include, but are not limited to, sodium, potassium, ammonium, and alkanolamine salts of sulfated butyl oleate, butyl recinoleate, etc.

Specific examples of the sulfated olefins include, but are not limited to, TEEPOL (from Shell Chemicals Limited.).

Specific examples of the salts of carboxymethylated compounds include, but are not limited to, salts of carboxymethylated aliphatic alcohols having 8 to 16 carbon atoms, and salts of carboxymethylated EO 1 to 10 mol adducts of aliphatic alcohols having 8 to 16 carbon atoms.

Specific examples of the salts of carboxymethylated aliphatic alcohols include, but are not limited to, carboxymethylated sodium salt of octyl alcohol, carboxymethylated sodium salt of lauryl alcohol, carboxymethylated sodium salt of tridecanol alcohol, etc.

Specific examples of the carboxymethylated EO 1 to 10 mol adducts of aliphatic alcohols include, but are not limited to, carboxymethylated sodium salt of EO 3 mol adduct of octyl alcohol, carboxymethylated sodium salt of EO 4 mol adduct of lauryl alcohol, carboxymethylated sodium salt of EO 3 mol adduct of DOVANOL® 23, etc.

Specific examples of the salts of sulfonic acids include, but are not limited to, salts of alkylbenzene sulfonic acids, salts of alkylnaphthalene sulfonic acids, diester-type sulfosuccinates, salts of α-olefin sulfonic acids, and sulfonic acid salts of compounds having an aromatic ring.

Specific examples of the salts of alkylbenzene sulfonic acids include, but are not limited to, sodium dodecylbenzene sulfonate. Specific examples of the salts of alkylnaphthalene sulfonic acids include, but are not limited to, sodium dodecylnaphthalene sulfonate. Specific examples of the diester-type sulfosuccinates include, but are not limited to, sodium di-2-ethylhexyl sulfosuccinate. Specific examples of the sulfonic acid salts of compounds having an aromatic ring include, but are not limited to, monosulfonate or disulfonate of alkylated diphenyl ether.

Specific examples of the salts of phosphoric acid esters include, but are not limited to, salts of phosphoric acid esters of higher alcohols and salts of phosphoric acid esters of EO adduct of higher alcohols.

Specific examples of the salts of phosphoric acid esters of higher alcohols include, but are not limited to, disodium salt of phosphoric acid monoester of lauryl alcohol, sodium salt of phosphoric acid diester of lauryl alcohol. Specific examples of the salts of phosphoric acid esters of EO adduct of higher alcohols include, but are not limited to, disodium salt of phosphoric acid monoester of EO 5 mol adduct of oleyl alcohol.

Specific examples of the cationic surfactants (S-2) include, but are not limited to, quaternary ammonium salts, amine salts, etc.

The quaternary ammonium salts are formed by a reaction between a tertiary amine and a quaternized agent (e.g., alkylating agents such as methyl chloride, methyl bromide, ethyl chloride, benzyl chloride, and dimethyl sulfate; and EO, etc.). Specific examples of the quaternary ammonium salts include, but are not limited to, lauryl trimethyl ammonium chloride, didecyl dimethyl ammonium chloride, dioctyl dimethyl ammonium bromide, stearyl trimethyl ammonium bromide, lauryl dimethyl benzyl ammonium chloride (benzalkonium chloride), cetylpyridinium chloride, polyoxyethylenetrimethyl ammonium chloride, stearamidoethyl diethyl methyl ammonium methosulfate, etc.

The amine salts are formed by neutralizing primary or secondary or tertiary amines with inorganic acids (e.g., hydrochloric acid, nitric acid, sulfuric acid, hydroiodic acid) or organic acids (e.g., acetic acid, formic acid, oxalic acid, lactic acid, gluconic acid, adipic acid, alkyl phosphoric acid).

Specific examples of the primary amine salts include, but are not limited to, inorganic acid salts or organic acid salts of aliphatic higher amines (such as lauryl amine, stearyl amine, cetyl amine, hydrogenated beef tallow amine, rosin amine), fatty acid (such as stearic acid and oleic acid) salts of lower amines.

Specific examples of the secondary amine salts include, but are not limited to, inorganic acid salts or organic acid salts of EO adducts of aliphatic amines.

Specific examples of the tertiary amine salts include, but are not limited to, inorganic acid salts or organic acid salts of aliphatic amines (e.g., triethyl amine, ethyl dimethyl amine, N,N,N',N'-tetramethylethyelene diamine), EO (2 or more mol) adducts of aliphatic amines, alicyclic amines (e.g., N-methylpyrrolidine, N-methylpiperidine, N-methylhexamethylene imine, N-methylmorpholine, 1,8-diazabicyclo(5,4,0)-7-undecene), aromatic amines having heterocyclic ring including nitrogen atom (e.g., 4-dimethylaminopyridine, N-methylimidazol, 4,4'-dipyridyl); and inorganic acid salts or organic acid salts of tertiary amines such as triethanolamine monostearate and stearamidoethyl diethyl methyl ethanolamine.

Specific examples of the amphoteric surfactants (S-3) include, but are not limited to, carboxylate-type amphoteric surfactants, sulfate-type amphoteric surfactants, sulfonate-type amphoteric surfactants, phosphate-type amphoteric surfactants, etc.

Specific examples of the carboxylate-type amphoteric surfactants include, but are not limited to, amino acid-type amphoteric surfactants, betaine-type amphoteric surfactants, imidazoline-type amphoteric surfactants, etc.

The amino acid-type amphoteric surfactants have an amino group and a carboxyl group in the same molecule. The following formula is an example of the amino acid-type amphoteric surfactants.

$$(R—NH-(CH_2)_n COO^-)_m M^{m+}$$

wherein R represents a monovalent hydrocarbon group; $M^{m+}$ represents a proton, an alkali metal ion, an alkaline-earth metal ion, an ammonium ion, an amine cation, an alkanolamine cation, etc.; and n represents an integer 1 or 2 and m represents an integer 1 or 2.

Specific examples of the amino acid-type amphoteric surfactants include, but are not limited to, alkylaminopropionic acid-type amphoteric surfactants (e.g., sodium stearylamine propionate, sodium laurylaminopropionate), alkylaminoacetic acid-type amphoteric surfactants (e.g., sodium laurylaminoacetic acid), etc.

The betaine-type amphoteric surfactants have a cationic portion of a quaternary ammonium salt and an anionic portion of a carboxylic acid. Specific examples of the betaine-type amphoteric surfactants include, but are not limited to, alkyldimethyl betaines (e.g., stearyldimethylaminoacetic acid betaine, lauryldimethylaminoacetic acid betaine), amide betaines (e.g., palm oil fatty acid amide propyl betaine), alkyldihydroxyalkyl betaine (e.g., lauryldihydroxyethyl betaine), etc.

Specific examples of the imidazoline-type amphoteric surfactants include, but are not limited to, 2-undecyl-N-carboxymethyl-N-hydroxyethyl imidazolinium betaine, etc.

Specific examples of the other amphoteric surfactants include, but are not limited to, glycine-type amphoteric surfactants (e.g., sodium lauroylglycine, sodium lauryldiaminoethylglycine, lauryldiaminoethylglycine hydrochloride, dioctyldiaminoethylglycine hydrochloride), sulfobetaine-type amphoteric surfactants (e.g., pentadecylsulfotaurine), etc.

Specific examples of the nonionic surfactants (S-4) include, but are not limited to, AO adduct-type nonionic surfactants and polyol-type nonionic surfactants.

The AO adduct-type nonionic surfactants can be formed by (1) directly adding AO to higher alcohols, higher fatty acids, alkylamines, etc., or (2) reacting higher fatty acids, etc. with polyalkylene glycols formed by adding AO to glycols, or (3) adding AO to esters formed by reacting higher fatty acids with polyols, or (4) adding AO to higher fatty acid amides.

The specific examples of the AO (alkylene oxide) include, but are not limited to, EO (ethylene oxide), PO (propylene oxide), and BO (butylene oxide). It is preferable that the adducted AO is a homopolymer of EO, or a random or a block copolymer of EO and PO.

The AO preferably has a polymerization degree of from 10 to 50. The AO preferably includes EO in an amount of from 50 to 100% by weight.

Specific examples of the AO adduct-type nonionic surfactants include, but are not limited to, alkyl ethers of oxyalkylenes (e.g., EO adducts of octyl alcohol, EO adducts of lauryl alcohol, EO adducts of stearyl alcohol, EO adducts of oleyl alcohol, EO-PO block adducts of octyl alcohol), higher fatty esters of polyoxyalkylenes (e.g., EO adducts of stearic acid, EO adducts of lauric acid), higher fatty esters of polyoxyalkylene polyols (e.g., lauric acid diester of polyethylene glycol, oleic acid diester of polyethylene glycol, stearic acid diester of polyethylene glycol), polyoxyalkylenealkyl phenyl ethers (e.g., EO adducts of nonylphenol, EO-PO block adducts of nonylphenol, EO adducts of octylphenol, EO adducts of bisphenol A, EO adducts of dinonylphenol, EO adducts of styrenated phenol), polyoxyalkylenealkyl aminoethers (e.g., EO adducts of lauryl amine, EO adducts of stearyl amine), polyoxyalkylenealkyl alkanolamides (e.g., EO adducts of hydroxyethyl lauric acid amide, EO adducts of hydropropyl oleic acid amide, EO adducts of dihydroxyethyl lauric acid amide), etc.

Specific examples of the polyol-type nonionic surfactants include, but are not limited to, fatty esters of polyols, AO adducts of fatty esters of polyols, alkyl ethers of polyols, AO adducts of alkyl ethers of polyols, etc.

Specific examples of the fatty esters of polyols include, but are not limited to, pentaerythritol monolaurate, pentaerythritol monooleate, sorbitan monolaurate, sorbitan monostearate, sorbitan dilaurate, sorbitan dioleate, sucrose monostearate, etc.

Specific examples of the AO adducts of fatty esters of polyols include, but are not limited to, EO adducts of ethylene glycol monooleate, EO adducts of ethylene glycol monostearate, EO-PO random adducts of trimethylolpropane monostearate, EO adducts of sorbitan monolaurate, EO adducts of sorbitan monostearate, EO adducts of sorbitan distearate, EO-PO random adducts of sorbitan dilaurate, etc.

Specific examples of the alkyl ethers of polyols include, but are not limited to, pentaerythritol monobutyl ether, pentaerythritol monolauryl ether, sorbitan monomethyl ether, sorbitan monostearyl ether, methyl glucoside, lauryl glucoside, etc.

Specific examples of the AO adducts of alkyl ethers of polyols include, but are not limited to, EO adducts of sorbitan monostearyl ether, EO-PO random adducts of methyl glucoside, EO adducts of lauryl glucoside, EO-PO random adducts of stearyl glucoside, etc.

Specific examples of the water-soluble polymers (T) include, but are not limited to, cellulosic compounds (e.g., methyl cellulose, ethyl cellulose, hydroxyethyl cellulose, ethyl hydroxyethyl cellulose, carboxymethyl cellulose, hydroxypropyl cellulose, and their saponified compounds), gelatin, starch, dextrin, gum arabic, chitin, chitosan, polyvinyl alcohol, polyvinyl pyrrolidone, polyethylene glycol, polyethylene imine, polyacrylamide, polymers including acrylic acid (or its salt) (e.g., sodium polyacrylate, potassium polyacrylate, ammonium polyacrylate, partially neutralized product of polyacrylic acid with sodium hydroxide, sodium acrylate-acrylic acid ester copolymer), (partially) neutralized product of styrene-maleic anhydride copolymer, water-soluble polyurethane (e.g., reaction products between polyisocyanate, and polyethylene glycols, polycaprolactone diol, etc.)

In the emulsifying process, the organic solvents (U) can optionally be added to either an aqueous medium for forming an aqueous dispersion, or a toner constituent mixture liquid. When the organic solvent (U) is added to an aqueous medium, the mixture preferably includes the organic solvent (U) in an amount of from 0 to 30% by weight, more preferably from 0 to 25% by weight, and much more preferably from 1 to 20% by weight. When the organic solvent (U) is added to a toner constituent mixture liquid, the mixture preferably includes the organic solvent (U) in an amount of from 0 to 80% by weight, more preferably from 0 to 70% by weight, and much more preferably from 1 to 60% by weight.

Specific examples of the organic solvents (U) include, but are not limited to, aromatic hydrocarbon solvents (e.g., toluene, xylene, ethylbenzene, tetralin), aliphatic or alicyclic hydrocarbon solvents (e.g., n-hexane, n-heptane, mineral spirit, cyclohexane), halogen solvents (e.g., methyl chloride, methyl bromide, methyl iodide, methylene chloride, carbon tetrachloride, trichloroethylene, perchloroethylene), ester or ester ether solvents (e.g., ethyl acetate, butyl acetate, methoxybutyl acetate, methyl cellosolve acetate, ethyl cellosolve acetate), ether solvents (e.g., diethyl ether, tetrahydrofuran, dioxane, ethyl cellosolve, butyl cellosolve, propylene glycol monomethyl ether), ketone solvents (e.g., acetone, methyl ethyl ketone, methyl isobutyl ketone, di-n-butyl ketone, cyclohexanone), alcohol solvents (e.g., methanol, ethanol, n-propanol, isopropanol, n-butanol, isobutanol, t-butanol, 2-ethylhexyl alcohol, benzyl alcohol), amide solvents (e.g., dimethyl formamide, dimethyl acetoamide), sulfoxide solvents (e.g., dimethyl sulfoxide), hetero-cyclic compound solvents (e.g., N-methylpyrrolidone), and mixtures or two or more thereof.

When the organic solvent (U) is added to an aqueous medium, the organic solvent (U) preferably has a solubility in water of from 0 to 40%, and more preferably from 1 to 25%. The organic solvents having such a solubility include, but are not limited to, ethyl acetate, butyl acetate, methyl ethyl ketone, methyl isobutyl ketone, etc.

In the emulsifying process, the plasticizer (V) can optionally be added to either an aqueous medium for forming an aqueous dispersion, or a toner constituent mixture liquid. Specific examples of the plasticizer (V) include, but are not limited to, esters of phthalic acids (e.g., dibutyl phthalate, dioctyl phthalate, butyl benzyl phthalate, diisodecyl phthalate), esters of aliphatic dibasic acids (e.g., di(2-ethylhexyl) adipate, 2-ethylhexyl sebacate), esters of trimellitic acids (e.g., tri(2-ethylhexyl) trimellitate, trioctyl trimellitate), esters of phosphoric acids (e.g., triethyl phosphate, tri(2-ethylhexyl) phosphate, tricresol phosphate), fatty esters (e.g., butyl oleate), and mixtures or two or more thereof.

The particle diameter of the particulate resin is typically smaller than that of the toner. In order to obtain a toner having a narrow particle diameter distribution, a particle diameter ratio between a particulate resin and a toner (i.e., a volume average particle diameter of a particulate resin/a volume average particle diameter of a toner) is preferably from 0.001 to 0.3, and more preferably from 0.003 to 0.25. When the ratio is too large, the particulate resin cannot effectively adsorb to the surface of the toner, and therefore the particle diameter distribution of the toner tends to widen.

The volume average particle diameter of the particulate resin can be controlled so that the resultant toner has a target particle diameter, unless the particle diameter ratio is within the above range.

The particulate resin preferably has a volume average particle diameter of from 0.005 to 2 μm. The maximum volume average particle diameter is preferably 1 μm, and more preferably 0.5 μm. The minimum volume average particle diameter is preferably 0.01 μm, more preferably 0.02 μm, and much more preferably 0.04 μm. For example, to obtain a toner having a volume average particle diameter of 1 μm, the particulate resin preferably has a volume average particle diameter of from 0.005 to 0.3 μm, and more preferably from 0.001 to 0.2 μm. To obtain a toner having a volume average particle diameter of 10 μm, the particulate resin preferably has a volume average particle diameter of from 0.005 to 3 μm, and more preferably from 0.001 to 2 μm. The particle diameter can be measured using instruments such as PARTICLE SIZE DISTRIBUTION ANALYZER LA-920 (from Horiba, Ltd.), Multisizer™ 3 COULTER COUNTER® (from Beckman Coulter Inc.), ELS-800 (from Otsuka Electronics Co., Ltd.) using a Laser Doppler optical system.

Toner Particles

The polyester-type resin for use in the toner of the present invention includes (1) a polyester resin (b1) formed by an addition polymerization between a first compound (m) having an active hydrogen group, and a cyclic ester (n); and/or (2) a polyurethane resin (b2) including the polyester resin (b1) as a unit.

Specific examples of the first compounds (m) having an active hydrogen group include, but are not limited to, any compounds capable of addition polymerization with the cyclic ester (n) such as alcohols, carboxylic acids, amines, polyester resins having a hydroxyl group and/or a carboxyl group, thiols, and mixtures thereof, but are not particularly limited.

Among alcohols, polyols having 2 to 6 valences are preferably used from the viewpoint of designing the toner composition freely.

Specific examples of the diols (polyols having 2 valences) include, but are not limited to, alkylene glycols having 2 to 36 carbon atoms (e.g., ethylene glycol, 1,2-propylene glycol, 1,3-propylene glycol, 1,4-butanediol, 1,6-hexanediol, octanediol, decanediol, dodecanediol, tetradecanediol, neopentyl glycol, 2,2-diethyl-1,3-propanediol), alkylene ether glycols having 4 to 100 carbon atoms (e.g., diethylene glycol, triethylene glycol, dipropylene glycol, polyethylene glycol, polypropylene glycol, polyethylene polypropylene glycol, polytetramethylene ether glycol), alicyclic diols having 4 to 36 carbon atoms (e.g., 1,4-cyclohexane dimethanol, hydrogenated bisphenol A), AO (such as EO, PO, BO) adducts (1 to 30 mol) of the above alicyclic diols, AO (such as EO, PO, BO) adducts (2 to 30 mol) of bisphenols (such as bisphenol A, bisphenol F, bisphenol S), polylactonediols (e.g., poly(ε-caprolactonediol)), vegetable oil polyols (e.g., divalent castor oil polyol), polybutadienediols, etc.

Other than the above diols having no functional group other than a hydroxyl group, diols having other functional groups can be used. For example, diols having a carboxyl group, diols having a sulfonic acid group or a sulfamic acid group, and neutralized salts thereof can be used.

Specific examples of the diols having a carboxyl group include, but are not limited to, dialkylolalkanoic acid having 6 to 24 carbon atoms (e.g., 2,2-dimethlolpropionic acid (DMPA), 2,2-dimethylolbutanoic acid, 2,2-dimethylolheptanoic acid, 2,2-dimethyloloctanoic acid), etc.

Specific examples of the diols having a sulfonic acid group or a sulfamic acid group include, but are not limited to, sulfamic acid diols (e.g., N,N-bis(2-hydroxyalkyl) sulfamic acids (alkyl group has 1 to 6 carbon atoms) and their AO (such as EO and PO) adducts (1 to 6 mol) such as N,N-bis(2-hydroxyethyl) sulfamic acid, PO 2 mol adduct of N,N-bis(2-hydroxyethyl) sulfamic acid, etc.), bis(2-hydroxyethyl) phosphate, etc.

Specific examples of the neutralized salts of these diols include, but are not limited to, tertiary amine salts having 3 to 30 carbon atoms (e.g., triethyl amine) and/or alkali metal salts (e.g., sodium salt).

Specific examples of the polyols having 3 to 6 valences include, but are not limited to, aliphatic polyols having 3 to 36 carbon atoms (e.g., alkane polyols and their intramolecular or intermolecular dehydration products such as glycerin, trimethylolethane, trimethylolpropane, pentaerythritol, sorbitol, sorbitan, polyglycerin, etc.; sugars and their derivatives such as glucose, fructose, etc.) and their AO adducts, AO adducts (2 to 100 mol) of trisphenols (e.g., trisphenol PA), AO adducts (2 to 30 mol) of novolac resins (e.g., phenol novolac, cresol novolac), acryl polyols (e.g., copolymer of hydroxyethyl (meth)acrylate and vinyl monomer), vegetable oil polyols (e.g., castor oil polyols having 3 to 6 valences), etc.

Specific examples of the carboxylic acids include, but are not limited to, aliphatic polycarboxylic acids having 2 or more valences and 4 to 18 carbon atoms (e.g., succinic acid, adipic acid, sebacic acid, glutaric acid, azelaic acid), aromatic polycarboxylic acids having 2 or more valences and 8 to 18 carbon atoms (e.g., terephthalic acid, isophthalic acid, trimellitic acid, pyromellitic acid), etc.

Specific examples of the amines include, but are not limited to, ammonia; aliphatic amines such as alkanolamines having 2 to 20 carbon atoms (e.g., monoethanolamine, diethanolamine, isopropanolamine, aminoethylethanolamine), alkylamines having 1 to 20 carbon atoms (e.g., n-butylamine, octylamine), alkylenediamines having 2 to 6 carbon atoms (e.g., ethylenediamine, propylenediamine, hexamethylenediamine), and polyalkylenepolyamines (e.g., dialkylenetriamine to hexaalkyleneheptamine in which alkylene group has 2 to 6 carbon atoms, such as diethylenetriamine and triethylenetetramine); aromatic monoamines and polyamines having 6 to 20 carbon atoms (e.g., aniline, phenylenediamine, thrylenediamine, xylylenediamine, diethyltoluenediamine, methylenedianiline, diphenyletherdiamine); alicyclic amines having 4 to 20 carbon atoms (e.g., isophoronediamine, cyclohexylenediamine, cyclohexylmethanediamine); heterocyclic amines having 4 to 20 carbon atoms (e.g., aminoethylpiperazine); etc.

Specific examples of the thiols include, but are not limited to, thiols having 2 to 4 thiol groups and 2 to 18 carbon atoms such as ethanedithiol, 1,2-propanedithiol, 1,3-propanedithiol, 1,4-propanedithiol, 1,4-benzenedithiol, 1,2-benzenedithiol, bis(4-mercaptophenyl) sulfide, 4-t-butyl-1,2-benzenethiol, ethylene glycol dithioglycolate, trimethylolpropane tris(thioglycolate)thiocyanuric acid, di(2-mercaptoethyl) sulfide, and di(2-mercaptoethyl) ether.

Specific examples of the polyester resins having a hydroxyl group and/or a carboxyl group include, but are not limited to, polycondensation products of the above-mentioned polyols having 2 to 6 valences with the above-mentioned polycarboxylic acids (aliphatic and/or aromatic polycarboxylic acids having 2 or more valences) or the acid anhydrides or lower alkyl esters thereof. The lower alkyl esters preferably have 1 to 4 carbon atoms, and therefore methyl ester, ethyl ester, isopropyl ester, etc. are preferably used.

Among these, polyols having 2 to 6 valences and polyester resins having a hydroxyl group and/or a carboxyl group are preferably used; and alkylene glycols having 2 to 36 carbon atoms, diols having a carboxyl group, AO adducts of bisphenols, alkylene ether glycols having 4 to 100 carbon atoms, aliphatic polyols having 3 to 6 valences, AO adducts of aliphatic polyols having 3 to 6 valences, AO adducts of novolac resins, castor oil polyols having 2 to 6 valences, polyester resins having a hydroxyl group and/or a carboxyl group, and mixtures thereof are more preferably used; and castor oil polyols having 2 to 4 valences, and polyester resins having a hydroxyl value of from 1 to 80 (preferably from 5 to 60) mgKOH/g and/or an acid value of from 1 to 40 (preferably 5 to 25) mgKOH/g are most preferably used. The hydroxyl value and the acid value can be measured by a method based on JIS K0070.

The above-mentioned dicarboxylic acids (13) and polycarboxylic acids (14) can be also used as the first compound (m) having an active hydrogen group.

Specific examples of the cyclic esters (n) include, but are not limited to, any compounds capable of producing a polyester by a ring-opening polymerization. In particular, L-lactide, D-lactide, DL-lactide, racemic lactide, glycolide, γ-butyrolactone, δ-valerolactone, and ϵ-caprolactone are preferably used because these compounds are easily obtainable. Among these, L-lactide, D-lactide, DL-lactide, racemic lactide, and mixtures of these lactides are more preferably used because these compounds can produce resins having high Tg and transparency. In particular, mixtures of 10 to 30% by weight of racemic lactide and other lactides are most preferably used because of having good solubility in solvents.

It is preferable that the cyclic ester (n) has an optical activity.

In this case, the polyester-type resin and/or the precursor of a polyester-type resin have a skeleton originated from the cyclic ester (n) having an optical activity.

When the toner includes a first polyester-type resin having a skeleton originated from one optical isomer of the cyclic ester (n) and a second polyester-type resin having a skeleton originated from the other optical isomer of the cyclic ester (n), the first polyester-type resin and the second polyester-type resin can form a stereocomplex upon application of heat.

When such the toner is fixed upon application of heat, the toner satisfies the following relationship:

$$C_{before} < C_{after}$$

wherein $C_{before}$ represents an amount of a stereocomplex existing in the toner, and $C_{after}$ represents an amount of a stereocomplex existing in a fixed image using the toner.

This relationship means that the polyester-type resins form a stereocomplex in the toner when the toner is fixed upon application of heat. The stereocomplex of the resins improves thermostable preservability and hot offset resistance of the toner. When $C_{before}$ and $C_{after}$ have same value, it means that a toner having low temperature fixability, hot offset resistance, and a wide fixable temperature range are not provided.

In particular, when resin particles including a first polyester-type resin (A) having a right-handed helical polymer unit (a) and a second polyester-type resin (B) having a left-handed helical polymer unit (b) are used as toner particles, the helical polymer units (a) and (b) are melted and mixed upon application of heat, resulting in formation of a stereocomplex of the helical polymer units (a) and (b). The stereocomplex forms a pseudo cross-linking structure in the toner, and thereby viscosity of the toner increases, resulting in improvement of hot offset resistance of the toner. When the toner is heat-melted, viscosity of the toner gradually increases as stereocomplex is formed, even if the primal viscosity is low. Therefore, the molecular weights of the polyester-type resins (A) and (B) can be decreased in order to improve low temperature fixability of the resultant toner while keeping good hot offset resistance thereof.

Resin particles including a first polyester-type resin (A) having 1 or more right-handed helical polymer unit (a) per molecule and/or a second polyester-type resin (B) having 1 or more left-handed helical polymer unit (b) per molecule can be used for the toner of the present invention. Each of the toner particles may include both the polyester-type resins (A) and (B), or either the polyester-type resin (A) or (B). It is preferable that the polyester-type resins (A) and (B) are included in one toner particle in order to form a stereocomplex easily. When the polyester-type resins (A) and (B) are included in one toner particle, the one toner particle consists essentially of fine particles of (A) and fine particles of (B) (i.e., the toner particle is a combined resin particle), and the helical polymer units (a) and (b) do not form a stereocomplex in the toner particle.

The polyester-type resins (A) and (B) preferably includes the helical polymer units (a) and (b), respectively, in an amount of from 1 to 10 per molecule, and more preferably 2 to 6 per molecule.

A weight ratio ((A)/(B)) between the polyester-type resins (A) and (B) is preferably from 20/80 to 80/20, more preferably from 30/70 to 70/30, and much more preferably from 40/60 to 60/40.

Whether a stereocomplex is formed or not can be determined by the wide-angle X-ray diffraction method. For example, when a polylactic acid resin forms a stereocomplex, a diffraction peak is observed in each of Bragg (2θ) angle ranges of from 11.3° to 12.3°, 20.1° to 21.1°, and 23.3° to 24.3°. In addition, whether a stereocomplex is formed or not can be also determined by the differential scanning calorimetry (DSC). When a stereocomplex is formed, an endothermic peak is observed in a temperature of about 50° C. higher than a temperature in which an endothermic peak specific to the polyester-type resin (A) or (B) is observed.

The toner of the present invention may be obtained, for example, by mixing a first toner including the polyester-type resin (A), and a second toner including the polyester-type resin (B). In this case, the polyester-type resins (A) and (B) do not form a stereocomplex in the toner unless the toner is fixed. Therefore, the toner has good low temperature fixability.

The toner of the present invention may also be obtained by aggregating a first primary particulate resin including the polyester-type resin (A), and a second primary particulate resin including the polyester-type resin (B). In this case, the polyester-type resins (A) and (B) are always located close to one another, and therefore a stereocomplex can be quickly formed. Since the aggregated particles are not heated to a high temperature of not less than 90° C. before being subjected to a fixing process, a stereocomplex is hardly formed before the toner is fixed.

In the present invention, the right-handed helical polymer unit (a) is formed by one optical isomer of the cyclic ester (n), and the left-handed helical polymer unit (b) is formed by the other optical isomer of the cyclic ester (n).

The helical polymer units (a) and (b) can be obtained by polymerizing each of the optical isomers of the cyclic ester (n), respectively. Each of the helical polymer units (a) and (b) may be a homopolymer of one optical isomer of the cyclic ester (n), or a copolymer of one optical isomer of the cyclic ester (n) and a second optically active monomer (o).

The copolymer is preferably a block copolymer having a portion of a homopolymer of the one optical isomer of the cyclic ester (n) or the second optically active monomer (o) because such a copolymer easily forms a helical polymer unit. The homopolymer and the portion of the homopolymer of the block copolymer preferably have a polymerization degree of from 10 to 100000, and more preferably from 50 to 8000. In this case, a stereocomplex can be easily formed.

It is generally known that a helical polymer can be formed by homopolymerizing an optically active monomer having an optical purity of 100%. Whether the helical unit is formed or not can be determined by the X-ray crystal structure analysis using an instrument such as AFC7R from Rigaku Corporation.

The cyclic ester (n) having an optical activity preferably has 3 to 6 carbon atoms including an asymmetric carbon atom. Specific examples of the cyclic esters (n) having an optical activity include, but are not limited to, L-lactide, D-lactide, α-methyl-α-ethyl-β-propiolactone, and β-(1,1-dichloropropyl)-β-propiolactone. Among these, L-lactide and D-lactide are preferably used.

The second optically active monomers (o) include, but are not limited to, monomers having an asymmetric carbon, and monomers capable of producing polymers having an asymmetric carbon. Specific examples of the second optically active monomers (o) include, but are not limited to, α-alkyl (having 1 to 4 carbon atoms)-α-hydroxycarboxylic acid, α-hydrocarbyl(having 1 to 12 carbon atoms)-α-amino acid, α-hydrocarbyl(having 1 to 8 carbon atoms) methacrylate, α-alkylethylene oxide (having 6 to 9 carbon atoms), α-alkylethylene sulfide (having 6 to 9 carbon atoms), etc.

Specific examples of the alkyl groups (having 1 to 4 carbon atoms) of the α-alkyl-α-hydroxycarboxylic acids include, but are not limited to, methyl group, ethyl group, isopropyl group, etc. Specific examples of the α-alkyl-α-hydroxycarboxylic acids include, but are not limited to, L-lactic acid and D-lactic acid.

Specific examples of the hydrocarbyl groups (having 1 to 12 carbon atoms) of the α-hydrocarbyl-α-amino acid include, but are not limited to, alkyl group, alkenyl group, cycloalkyl group, aryl group, and aralkyl group (e.g., methyl group, ethyl group, phenyl group, benzyl group, α-methylbenzyl). Specific examples of the α-hydrocarbyl-α-amino acids include, but are not limited to, γ-benzyl glutamic acid and γ-methyl glutamic acid.

Specific examples of the hydrocarbyl groups (having 1 to 12 carbon atoms) of the α-hydrocarbyl methacrylate include, but are not limited to, alkyl group, alkenyl group, cycloalkyl group, aryl group, and aralkyl group (e.g., methyl group, ethyl group, phenyl group, benzyl group, α-methylbenzyl). Specific examples of the α-hydrocarbyl methacrylates include, but are not limited to, α-methylbenzyl methacrylate and methyl methacrylate.

Specific examples of the alkyl groups of the α-alkylethylene oxide include, but are not limited to, methyl group, ethyl group, isopropyl group, etc. Specific examples of the α-alkylethylene oxides include, but are not limited to, t-butylethylene oxide.

Specific examples of the alkyl groups of the α-alkylethylene sulfide include, but are not limited to, methyl group, ethyl group, isopropyl group, etc. Specific examples of the α-alkylethylene sulfides include, but are not limited to, t-butylethylene sulfide.

Among these, L-lactic acid, D-lactic acid, t-butylethylene oxide, t-butylethylene sulfide, and mixtures thereof are preferably used because these monomers can easily from a helical polymer unit. It is more preferable to use L-lactic acid and D-lactic acid.

The helical polymer units (a) and (b) can be formed by addition polymerization, ring-opening polymerization, polyaddition reaction, addition condensation, condensation polymerization, etc. of monomers. Among these, ring-opening polymerizations of cyclic monomers (e.g., cyclic esters having an optical activity, α-alkylethylene oxide, α-alkylethylene sulfide) and dehydration condensations of hydroxycarboxylic acids are preferably used, because polymers having stereoregularity are easily produced by these reactions.

Any known catalysts can be used for the ring-opening polymerization and the dehydration condensation. Specific examples of basic catalysts include, but are not limited to, hydroxides of alkali metals (e.g., Li, Na, K), alcoholates of alkali metals (e.g., Li, Na, K), alkyl amines (e.g., monoalkyl amine, dialkyl amine, trialkyl amine), etc. Specific examples of acid catalysts include, but are not limited to, Lewis acid catalyst such as halides or alkoxides of metals (e.g., Al, Sb, B, Be, P, Fe, Zn, Ti, Zr), inorganic acids (e.g., HCl, HBr, $H_2SO_4$, $HClO_4$), organic acids (e.g., acetic acid, oxalic acid), etc. These can be used alone or in combination. The catalyst is preferably added in an amount of from 0.001 to 5% by weight based on the total weight of the monomers.

Methods for introducing the helical polymer units (a) and (b) to the polyester-type resins (A) and (B), respectively, are not particularly limited. For example, monomers for forming the helical polymer units (a) and (b) can be graft polymerized to the polyester-type resins (A) and (B), or connected to the polyester-type resins (A) and (B).

Specific examples of the graft polymerization methods include, but are not limited to, polycondensation reactions to a functional group (e.g., hydroxyl group, carboxyl group, amino group) having an active hydrogen of the polyester-type resin, ring-opening polymerization reactions, and vinyl polymerization reactions to a vinyl polymerizable group of the polyester-type resin. Specific examples of the connecting methods include, but are not limited to, reactions between a functional group (e.g., hydroxyl group, thiol group, carboxyl group) having an active hydrogen of the helical polymer unit and a functional group (e.g., isocyanate group, thioisocyanate group, epoxy group) reacting with an active hydrogen of the polyester-type resin; a method in which connecting a functional group having an active hydrogen of the polyester-type resin, and a functional group having an active hydrogen group of the helical polymer unit, by a compound having 2 or more functional groups (e.g., isocyanate group, epoxy group) reacting with an active hydrogen.

The polyester-type resin (A) and (B) preferably include the helical polymer units (a) and (b), respectively, in an amount of from 10 to 99% by weight, more preferably from 30 to 97% by weight, and much more preferably from 50 to 95% by weight.

The toner of the present invention can include first toner particles including the first polyester-type resin (A) and second toner particles including the second polyester-type resin (B). The first toner particles and the second toner particles are respectively obtainable by the following methods.

The first method includes:

dissolving or dispersing toner constituents including at least the polyester-type resin and a colorant in a monomer to prepare a toner constituent mixture liquid;

emulsifying the toner constituent mixture liquid in an aqueous medium to prepare a dispersion including the toner constituent; and subjecting the dispersion including the toner constituent to a polymerization to prepare toner particles.

The second method includes:

dispersing toner constituents including at least the polyester-type resin and a colorant in an aqueous medium to prepare a dispersion including the toner constituent;

aggregating the toner constituents in the dispersion including the toner constituent to prepare aggregated particles; and heating and fusing the aggregated particles to prepare toner particles.

The third method includes:

dissolving or dispersing toner constituents including at least the polyester-type resin and a colorant in an organic solvent to prepare a toner constituent mixture liquid;

emulsifying the toner constituent mixture liquid in an aqueous medium to prepare a dispersion including the toner constituent; and removing the organic solvent in the dispersion including the toner constituent to prepare toner particles.

The fourth method includes:

dissolving or dispersing toner constituents including at least the polyester-type resin and a colorant in an organic solvent to prepare a toner constituent mixture liquid;

emulsifying the toner constituent mixture liquid in an aqueous medium to prepare a dispersion including the toner constituent;

addition-polymerizing the dispersion including the toner constituent; and removing the organic solvent in the dispersion including the toner constituent to prepare toner particles.

The toner of the present invention is obtainable by mixing the thus prepared first toner particles and second toner particles using any known mixing devices under typical mixing conditions.

The mixing temperature is preferably from 0 to 80° C., and more preferably from 10 to 60° C., but is not particularly limited. The mixing time is preferably not less than 3 minutes, and more preferably from 5 to 60 minutes, but is not particularly limited. Specific examples of the mixing devices include HENSCHEL MIXER, NAUTER MIXER, BANBURY MIXER, etc. but are not particularly limited. Among these, HENSCHEL MIXER is preferably used. A mixture of the first toner particles and the second toner particles is in powder state, and therefore the helical polymer units (a) and (b) do not form a stereocomplex.

The toner of the present invention may include toner particles in which both the polyester-type resins (A) and (B) are included in each of the toner particles. Such toner particles can be obtained by aggregating a first primary particulate resin including the polyester-type resin (A), and a second primary particulate resin including the polyester-type resin (B). In particular, such toner particles are obtainable by the following method:

(1) preparing an aqueous dispersion including the polyester-type resin (A) and an aqueous dispersion including the polyester-type resin (B), respectively; and (2) mixing the above two aqueous dispersions, and removing a solvent.

The thus prepared toner particles includes fine particles of both the polyester-type resins (A) and (B), i.e., the toner particle is a composite particle. The helical polymer units (a) and (b) essentially do not form a stereocomplex in such toner particles unless the toner is fixed, i.e., a part of the polyester-type resins (A) and (B) form a stereocomplex at an interface at which the primary particulate resins are aggregated, however, most of the polyester-type resins (A) and (B) do not form a stereocomplex because these resins are isolated from each other.

The aggregated particles are preferably not subjected to a temperature of 90° C. or more, more preferably not subjected to a temperature of 80° C. or more, after the aggregated particles are formed (until the toner is fixed). In this case, a formation of a stereocomplex of the polyester-type resins (A) and (B) at an interface at which the resins (A) and (B) are aggregated is kept to the minimum, resulting in improvement of low temperature fixability.

A method for preparing a polyester resin by addition polymerizing the first compound (m) having an active hydrogen group with the cyclic ester (n) is not particularly limited. The addition polymerization can be performed in the same way as a typical esterification reaction. For example, a mixture of the first compound (m) having an active hydrogen group, the cyclic ester (n), a polymerization catalyst, and optionally a solvent is fed in a reaction vessel equipped with a stirrer, and then the mixture is agitated at a reacting temperature (for example, 120 to 300° C.) under nitrogen atmosphere to prepare a polyester resin. The primary reaction pressure can be high, normal, and low. The polymerization catalyst can be added at one time, or several times.

As the polyurethane resin (b2) including the polyester resin (b1) as a unit, polyaddition products of the polyisocyanates (15) with the compounds (D) having an active hydrogen group can be used. In this case, the polyester resin (b1) must be used as one member of the compounds (D) having an active hydrogen group. The compounds (D) having an active hydrogen group preferably includes the polyester resin (b1) in an amount of not less than 40% by weight, more preferably not less than 70% by weight, much more preferably not less than 90% by weight, and most preferably 100% by weight.

As mentioned above, the polyester-type resin for use in the toner of the present invention preferably includes (1) a polyester resin (b1) formed by an addition polymerization between a first compound (m) having an active hydrogen group with a cyclic ester (n), and/or (2) a polyurethane resin (b2) including the polyester resin (b1) as a unit. However, other resins such as polyester resins other than the polyester resin (b1), polyurethane resins, vinyl resins, and epoxy resins can be used in combination. The polyester-type resin preferably includes the other resins in an amount of not greater than 70%, more preferably not greater than 30%, and much more preferably not greater than 10%.

The number average molecular weight (Mn), melting point, glass transition temperature (Tg), and SP value of the polyester-type resin can be controlled as appropriate.

When the polyester-type resin is used for a toner for use in electrophotography, electrostatic recording, electrostatic printing etc., the polyester-type resin typically has an Mn of from 1,000 to 5,000,000, and preferably from 2,000 to 500,000. The polyester-type resin typically has a melting point of from 20 to 300° C., and preferably from 80 to 250° C. The polyester-type resin typically has a Tg of from 20 to 200° C., and preferably from 40 to 200° C. The polyester-type resin typically has an SP value of from 8 to 16, and preferably from 9 to 14.

In the present invention, a polyester-type resin or its solution is dispersed in an aqueous medium including a particulate resin to obtain an aqueous dispersion of a toner in which the particulate resin is adhered to the surface thereof. Or, after-mentioned precursor of a polyester-type resin or its solution is dispersed in an aqueous dispersion of a toner in which the particulate resin is adhered to the surface thereof.

When a polyester-type resin or its solution (and a precursor of a polyester-type resin or its solution) is dispersed, a dispersing device can be used. Any known marketed dispersing devices such as emulsifying machines, dispersing machines, can be used. Specific examples of the dispersing devices include, but are not limited to, batch-type emulsifying machines such as HOMOGENIZER (from IKA Japan), POLYTRON® (from KINEMATICA AG), and TK AUTO HOMO MIXERS® (from Tokushu Kika Kogyo Co., Ltd.); continuous emulsifying machines such as EBARA MILDER® (from Ebara Corporation), TK FILMICS and TK PIPELINE HOMO MIXER® (from Tokushu Kika Kogyo Co., Ltd.), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); high pressure emulsifying machines such as MICRO FLUIDIZER (from Mizuho Industrial Co., Ltd.), NANOMIZER (from S. G. Engineering Inc.), and APV GAULIN (from Invensys); membrane emulsifying machine (from Reica Co., Ltd.); vibration emulsifying machines such as VIBRO MIXER (from Reica Co., Ltd.); ultra-sonic emulsifying machines such as SONIFIER (from Branson Ultrasonics Division of Emerson Japan Ltd.); etc. Among these, APV GAULIN, HOMOGENIZER, TK AUTO HOMO MIXER®, EBARA MILDER®, TK FILMICS, and TK PIPELINE HOMO MIXER® are preferably used from the viewpoint of obtaining a toner having a narrow particle diameter distribution.

When a polyester-type resin (and a precursor of a polyester-type resin) is dispersed in an aqueous medium, the polyester-type resin (and the precursor of a polyester-type resin) is preferably in a liquid state. If the polyester-type resin (and the precursor of a polyester-type resin) is solid at room temperature, it is preferable that the polyester-type resin (and the precursor of a polyester-type resin) is liquefied upon application of high temperature of not less than the melting point thereof, or is dissolved in a solution. The liquid or the solution of the polyester-type resin (and the precursor of a polyester-type resin) typically has a viscosity of from 10 to 50,000 cP, and preferably from 100 to 10,000 cP (measured by B-type viscometer), from the viewpoint of obtaining a toner having a narrow particle diameter distribution. The dispersing temperature is typically from 0 to 150° C., and preferably from 5 to 98° C. (under pressure). When a dispersing material has too high a viscosity, it is preferable that the material is heated so as to decrease the viscosity to the above appropriate level before being dispersed. Any organic solvents capable of dissolving the polyester-type resin (and the precursor of a polyester-type resin) at room temperature or under application of heat are preferably used for the solution thereof, and are not particularly limited. Specific examples of the organic solvents include, but are not limited to, the above-mentioned organic solvents (U). It is preferable that the difference of the SP values between the organic solvent and the polyester-type resin (and the precursor of a polyester-type resin) is not greater than 3. The organic solvents in which the polyester-type resin (and the precursor of a polyester-type resin) is easily dissolved but the particulate resin is hardly dissolved or swelled are preferably used from the viewpoint of obtaining a toner having a narrow particle diameter distribution.

As the precursor of a polyester-type resin, any compounds capable of becoming a polyester-type resin by being subjected to a chemical reaction can be used, and is not particularly limited. Specific examples of the precursors of a polyester-type resin include, but are not limited to, prepolymers (α) having a reactive group. A polyester-type resin is formed by reacting the prepolymer (α) having a reactive group with a curing agent (β). In this regard, the "reactive group" is defined as a group having reactivity with the curing agent (β). Specific examples of methods for forming a polyester-type resin by reacting a precursor of a polyester-type resin include, but are not limited to:

(1) dispersing a mixture including the prepolymer (α) having a reactive group, the curing agent (β), and optionally the organic solvent (U) in an aqueous medium including a particulate resin, and then heating the mixture so that the prepolymer (α) having a reactive group and the curing agent (β) are reacted;

(2) dispersing the prepolymer (α) having a reactive group or its solution in an aqueous medium including a particulate resin, and then adding the curing agent (β) thereto so as to react with the prepolymer (α) having a reactive group; and (3) dispersing the prepolymer (α) having a reactive group or its solution in an aqueous medium including a particulate resin so as to react with water (when the prepolymer (α) having a reactive group has reactivity with water).

Specific examples of the combinations of the prepolymer (α) having a reactive group and the curing agent (β) are as follows:

(1) A reactive group of the prepolymer (α) is a functional group (α1) having reactivity with an active hydrogen group, and the curing agent (β) is a compound (β1) having the active hydrogen group; and (2) A reactive group of the prepolymer (α) is an active hydrogen group (α2), and the curing agent (β) is a compound (β2) having reactivity with the active hydrogen group.

Among these, the combination of the above (1) is preferably used from the viewpoint of their reactivity in water. Specific examples of the functional groups (α1) having reactivity with an active hydrogen group include, but are not limited to, isocyanate group (α1a), blocked-isocyanate group (α1b), epoxy group (α1c), acid anhydride group (α1d), acid halide group (α1e), etc. Among these, isocyanate group (α1a), blocked-isocyanate group (α1b), and epoxy group (α1c) are preferably used, and isocyanate group (α1a) and blocked-isocyanate group (α1b) are more preferably used. In this regard, the "blocked-isocyanate group (α1b)" is an isocyanate group blocked by a blocking agent.

Specific examples of the blocking agents include, but are not limited to, oximes (e.g., acetoxime, methyl isobutyl ketoxime, diethyl ketoxime, cyclopentanone oxime, cyclohexanone oxime, methyl ethyl ketoxime), lactams (e.g., γ-butylolactam, ϵ-caprolactam, γ-valerolactam), aliphatic alcohols having 1 to 20 carbon atoms (e.g., ethanol, methanol, octanol), phenols (e.g., phenol, m-cresol, xylenol, nonylphenol), active methylene compounds (e.g., acetylacetone, ethyl malonate, ethyl acetoacetate), compounds having basic nitrogen (e.g., N,N-diethylhydroxyamine, 2-hydroxypyridine, pyridine-N-oxide, 2-mercaptopyridine), and mixtures thereof. Among these, oximes are preferably used, and methyl ethyl ketoxime is more preferably used.

The prepolymer (α) having a reactive group preferably has a polyester skeleton formed by a ring-opening addition polymerization of the cyclic ester (n) with the first compound (m) having an active hydrogen group. Specific examples of methods for modifying a reactive group to a polyester resin are as follows:

(1) remaining a functional group of a first constituent on an end of a product by using an excessive amount of the first constituent compared to a second or more constituents; and (2) remaining a functional group of a first constituent on an end of a product by using an excessive amount of the first constituent compared to a second or more constituents, and then reacting a compound including a functional group having reactivity to the remained functional group thereto.

As an example of the method (2), when a prepolymer obtained by the above method (1) is reacted with a polyisocyanate, a prepolymer having an isocyanate group can be obtained. When the prepolymer is reacted with a blocked-polyisocyanate, a prepolymer having a blocked-isocyanate group can be obtained. When the prepolymer is reacted with a polyepoxide, a prepolymer having an epoxy group can be obtained. When the prepolymer is reacted with a poly acid anhydride, a prepolymer having an acid anhydride group can be obtained.

A ratio between the remaining functional group and the compound including a functional group having reactivity with the remaining functional group is, for example, when a polyester resin having a hydroxyl group is reacted with a polyisocyanate to obtain a polyester prepolymer having an isocyanate group, the equivalent ratio ([NCO]/[OH]) between an isocyanate group [NCO] and a hydroxyl group [OH] of the polyester resin having a hydroxyl group is typically from 1/1 to 5/1, preferably from 1.2/1 to 4/1, and more preferably from 1.5/1 to 2.5/1. Even if other prepolymers having different skeletons or different remaining functional groups are used, the above preferable ratio is not changed.

The prepolymer (α) having a reactive group typically includes a reactive group in number not less than 1 per one molecule, preferably 1.5 to 3 per one molecule, and more preferably 1.8 to 2.5 per one molecule, in an average value. In this case, the resultant polyester-type resin formed by reacting with the curing agent (β) has high molecular weight.

The prepolymer (α) typically has a number average molecular weight (Mn) of from 500 to 30,000, preferably from 1,000 to 20,000, and more preferably from 2,000 to 10,000.

The prepolymer (α) typically has a weight average molecular weight (Mw) of from 1,000 to 50,000, preferably from 2,000 to 40,000, and more preferably from 4,000 to 20,000.

The prepolymer (α) typically has a viscosity of not greater than 2000 poise, and preferably not greater than 1000 poise, at 100° C. In this case, a toner having a narrow particle diameter distribution can be obtained by using a small amount of an organic solvent.

Specific examples of the second compounds (β1) having an active hydrogen group include, but are not limited to, polyamines (β1a) which may be blocked by a releasable compound, polyols (β1b), polymercaptans (β1c), water (β1d), etc. Among these, polyamines (β1a), polyols (β1b), and water (β1d) are preferably used, polyamines (β1a) and water (β1d) are more preferably used, and blocked-polyamines and water (β1d) are much more preferably used.

Specific examples of the polyamines (β1a) include, but are not limited to, the polyamines (16) (e.g., 4,4'-diaminodiphenylmethane, xylylene diamine, isophorone diamine, ethylene diamine, diethylene triamine, triethylene tetramine; and mixtures thereof).

Specific examples of the blocked-polyamines include, but are not limited to, ketimine compounds formed by polyamines and ketones having 3 to 8 carbon atoms (such as acetone, methyl ethyl ketone, and methyl isobutyl ketone), aldimine compounds formed by polyamines and aldehyde compounds having 2 to 8 carbon atoms (such as formaldehyde and acetoaldehyde), enamine compounds, oxazolidine compounds, etc.

Specific examples of the polyols (β1b) include, but are not limited to, the diols (11) and the polyols (12). Among these, the diols (11) or a mixture of the diols (11) and a little amount of the polyols (12) are preferably used.

Specific examples of the polymercaptans (β1c) include, but are not limited to, ethylenedithiol, 1,4-butanedithiol, 1,6-hexanedithiol, etc.

In addition, a reaction stopping agent (βs) can be used in combination with the second compounds (β1) having an active hydrogen group, if desired. In this case, the molecular weight of the polyester-type resin can be controlled as appropriate.

Specific examples of the reaction stopping agent (βs) include, but are not limited to, monoamines (e.g., diethylamine, dibutylamine, butylamine, laurylamine, monoethanolamine, diethanolamine), blocked-monoamines (e.g., ketimine compounds), alcohols (e.g., methanol, ethanol, isopropanol, butanol, phenol), monomercaptans (e.g., butyl mercaptan, lauryl mercaptan), monoisocyanates (e.g., lauryl isocyanate, phenyl isocyanate), monoepoxides (e.g., butyl glycidyl ether), etc.

Specific examples of the active hydrogen group (α2) of the prepolymer (α) having a reacting group include, but are not limited to, amino group (α2a), hydroxyl group (alcoholic hydroxyl group and phenolic hydroxyl group) (α2b), mercapto group (α2c), carboxyl group (α2d), and their blocked-groups (α2e) blocked by a releasable compound, etc. Among these, amino group (α2a), hydroxyl group (α2b), and the blocked-groups (α2e) are preferably used, and hydroxyl group (α2b) is more preferably used.

The blocked-groups (α2e) can be blocked by the releasable compounds same as the above blocked-polyamines.

Specific examples of the compounds (β2) having reactivity with an active hydrogen group include, but are not limited to, polyisocyanates (β2a), polyepoxides (β2b), polycarboxylic acids (β2c), poly acid anhydrides (β2d), polycarboxylic acid halides (β2e), etc. Among these, polyisocyanates (β2a) and polyepoxides (β2b) are preferably used, and polyisocyanates (β2a) are more preferably used.

Specific examples of the polyisocyanates (β2a) include, but are not limited to, the polyisocyanates (15).

Specific examples of the polyepoxides (β2b) include, but are not limited to, the polyepoxides (18).

Specific examples of the polycarboxylic acids (β2c) include, but are not limited to, dicarboxylic acids (β2c-1) and polycarboxylic acids (β2c-2) having 3 or more valences. Among these, dicarboxylic acids (β2c-1) and a mixture of the dicarboxylic acids (β2c-1) and a little amount of the polycarboxylic acids (β2c-2) are preferably used.

Specific examples of the dicarboxylic acids (β2c-1) and the polycarboxylic acids (β2c-2) having 3 or more valences include, but are not limited to, the dicarboxylic acids (13) and the polycarboxylic acids (5), respectively.

Specific examples of the poly acid anhydrides (β2d) include, but are not limited to, pyromellitic anhydrides, etc. Specific examples of the polycarboxylic acid halides (β2e) include, but are not limited to, halides (such as acid halides, acid bromides, acid iodides) of the polycarboxylic acids (β2c), etc.

In addition, the reaction stopping agent (βs) can be used in combination with the polycarboxylic acids (β2c), if desired.

An equivalent ratio ([α]/[β]) between an equivalent [α] of a reactive group of the prepolymer (α) and an equivalent [β] of an active hydrogen group of the curing agent (β) is typically from 1/2 to 2/1, preferably from 1.5/1 to 1/1.5, and more preferably from 1.2/1 to 1/1.2. When the curing agent (β) is water (β1d), water is treated as a compound having a divalent active hydrogen.

A polyester-type resin (C) formed by reacting the prepolymer (α) having a reactive group and the curing agent (β) in an aqueous medium is a component of the second preferred embodiment of the toner of the present invention. The polyester-type resin (C) formed by reacting the prepolymer (α) having a reactive group and the curing agent (β) typically has a weight average molecular weight (Mw) of not less than 3,000, preferably from 3,000 to 10,000,000, and more preferably from 5,000 to 1,000,000.

In the second preferred embodiment of the toner of the present invention, when the prepolymer (α) having a reactive group and the curing agent (β) are reacted in an aqueous medium, a polyester resin (D) which does not react with the prepolymer (α) having a reactive group and the curing agent (β) is also added in the aqueous medium. In this case, a weight ratio (α/D) of the prepolymer (α) to the polyester resin (D) is preferably from 5/95 to 80/20. A resin formed by the prepolymer (α) and the polyester resin (D) preferably has an acid value of from 1 to 30 mgKOH/g, and a glass transition temperature (Tg) of from 40 to 70° C.

A reaction time of the prepolymer (α) having a reactive group and the curing agent (β) depends on the kind of the reacting group of the prepolymer (α) and the kind of their combination, and is preferably from 10 minutes to 40 hours, and more preferably from 30 minutes to 24 hours. A reaction temperature is typically from 0 to 150° C., and preferably from 50 to 120° C.

Any known catalysts can be used, if desired. Specific examples of the catalysts for a reaction between an isocyanate and a compound having an active hydrogen group include, but are not limited to, dibutyl tin laurate, dibutyloctyl tin laurate, etc.

In order to remove an organic solvent from the emulsion, a method in which the reaction system is gradually reduced in pressure and/or heated is used.

In addition, a method in which the emulsion is sprayed into a dry atmosphere to remove an organic solvent in droplets of the emulsion, resulting in formation of toner particles, can be used. A dispersing agent, etc. can also be removed at the same time. Specific examples of the dry atmospheres include, but are not limited to, gases such as air, nitrogen gas, carbon dioxide gas, combustion gas, etc., which are typically heated to a temperature of not less than boiling point of an organic solvent having the highest boiling point among the solvents used in the emulsion. The organic solvents can be quickly removed from the emulsion when using a spray dryer, a belt dryer, a rotary kiln, etc.

In order to remove an aqueous medium from the emulsion, a filtration is preferably used.

When particles in the emulsion have a wide particle diameter distribution, and the particle diameter distribution is not changed even after the particles are subjected to washing and drying treatment, particles can be classified to have a target particle diameter distribution.

The particles can be classified by removing fine particles by methods such as cyclone, decantation, centrifugal separation, etc. in a liquid. Of course, the dried particles can be classified by the above methods. However, the classification is preferably preformed in a liquid from the viewpoint of efficiency. Removed fine particles and coarse particles can be recycled in toner particle formation process. The removed fine particles and coarse particles may be wet.

The dispersing agent used in the emulsion is preferably removed therefrom in the classification process.

The dried toner particles can be mixed with other particulate materials such as release agent, charge controlling agent, fluidizer, colorant, etc., optionally upon application of a mechanical impact thereto to fix and fuse the particulate materials on the surface of the toner particles.

Specific examples of such mechanical impact application methods include, but are not limited to, methods in which a mixture is mixed with a highly rotated blade and methods in which a mixture is put into an air jet to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), automatic mortars, etc.

The particulate resin is added in the toner particle formation process in order to control the after-mentioned toner shape (such as circularity and shape factor). It is important that the resultant toner includes the particulate resin remaining on the surface thereof in an amount of not greater than 2.5% by weight. For this reason, excess particulate resin remaining on the surface of the toner is preferably washed and removed to some extent. When too large an amount of the particulate resin remains on the surface of the toner, the particulate resin tends to inhibit the toner fixation to a paper, resulting in deterioration of low temperature fixability. As a result, the resultant toner has a narrow fixable temperature range. Such a toner cannot be well fixed in a low-temperature fixing system, and therefore the fixed image is easily peeled off by being scratched. In addition, the particulate resin remaining on the surface of the toner tends to deteriorate chargeability of the toner. As a result, problems such that the produced image has a background fouling, toner scattering is occurred in a developing region, and the toner contaminates image forming members are caused.

The amount of the remaining particulate resin can be measured by pyrolysis gas chromatography (mass spectrometry).

Particle Diameter

The toner of the present invention preferably has a volume average particle diameter (D4) of from 4 to 8 μm; and a ratio (D4/D1) between the volume average particle diameter (D4) and a number average particle diameter (D1) of from 1.00 to 1.25, and more preferably from 1.10 to 1.25.

Typically, a toner having a small particle diameter has an advantage in terms of producing high definition and high quality images, but has a disadvantage in terms of transferability and cleanability. When the D4 is too small, the toner tends to fuse on the surface of the carrier by long-term agitation in a developing device, resulting in deterioration of chargeability of a carrier, when the toner is used for a two-component developer. When the toner is used for a one-component developer, problems such that the toner forms a film on a developing roller, and the toner fuses on a toner layer forming member tend to be caused.

In contrast, when the D4 is too large, it is difficult to obtain high definition and high quality images. In addition, an average particle diameter of a toner included in a developer tends to be largely changed when a part of toner particles are replaced with fresh toner particles. When D4/D1 is too large, the same phenomena occur. When D4/D1 is too small, the toner can be uniformly charged and the toner behavior is stable in an image forming apparatus, but in contrast, the toner cannot be sufficiently charged and cleanability of the toner deteriorates.

Average Circularity

The toner of the present invention preferably has an average circularity of from 0.94 to 0.96.

The average circularity of the toner can be determined by a flow-type particle image analyzer, FPIA-2100 manufactured by Sysmex Corp.

Specifically, the method is as follows:

(1) 0.1 g to 0.5 g of a sample to be measured is mixed with 100 ml to 150 ml of water from which solid impurities have been removed and which includes 0.1 ml to 0.5 ml of a dispersant (i.e., a surfactant) such as an alkylbenzene sulfonic acid salt;

(2) the mixture is dispersed using an ultrasonic dispersing machine for about 1 to 3 minutes to prepare a suspension including particles of 3,000 to 10,000 per micro-liter of the suspension; and (3) the average circularity and circularity distribution of the sample in the suspension are determined by the measuring instrument mentioned above.

Shape Factors

Figure 1B:
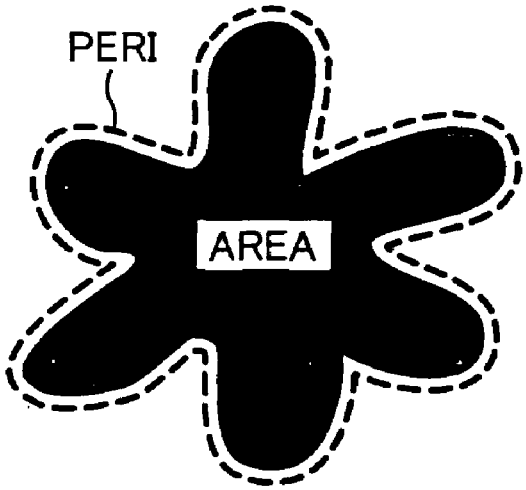

The toner of the present invention preferably has a shape factor SF-1 of 100 to 180 and another shape factor SF-2 of 100 to 180. FIGS. 1A and 1B are schematic views for explaining the shape factors SF-1 and SF-2 respectively.

As illustrated in FIG. 1A, the shape factor SF-1 represents the degree of the roundness of a toner particle, and is defined by the following equation (1):

$$SF\text{-}1=\{(MXLNG)^2/(\text{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. When the SF-1 is larger than 100, the toner particles have irregular forms.

As illustrated in FIG. 1B, the shape factor SF-2 represents the degree of the concavity and convexity of a toner particle, and is defined by the following equation (2):

$$SF\text{-}2=\{(PERI)^2/(\text{AREA})\}\times(100\pi/4) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity). When the SF-2 is large, the toner particles are roughened.

The shape factors SF-1 and SF-2 are determined by the following method:

(1) particles of a toner are photographed using a scanning electron microscope (S-800, manufactured by Hitachi Ltd.); and (2) photographic images of toner particles are analyzed using an image analyzer (LUZEX 3 manufactured by Nireco Corp.) to determine the SF-1 and SF-2.

When the toner particles have spherical form, the toner particles contact the other toner particles and the photoreceptor at one point. Therefore, the adhesion of the toner particles to the other toner particles and the photoreceptor decreases, resulting in increase of the fluidity of the toner particles and the transferability of the toner. In addition, dot reproducibility also improves. In contrast, when the SF-1 and SF-2 are large, the toner particles have irregular forms and therefore cleanability improves. The toner of the present invention preferably has shape factors SF-1 and SF-2 of from 100 to 180, respectively, in order to keep good balance between transferability and cleanability.

<Size Factors>

Figure 2A:
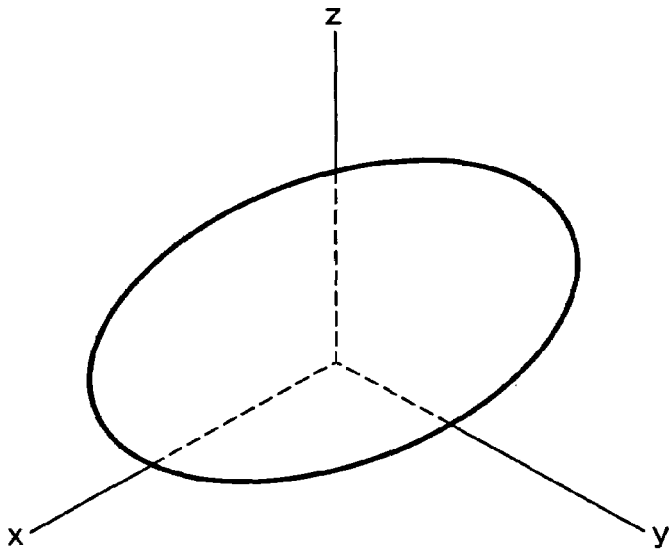
FIGS. 2A-2C are schematic views illustrating a typical particle of the toner of the present invention.
Figure 2B:
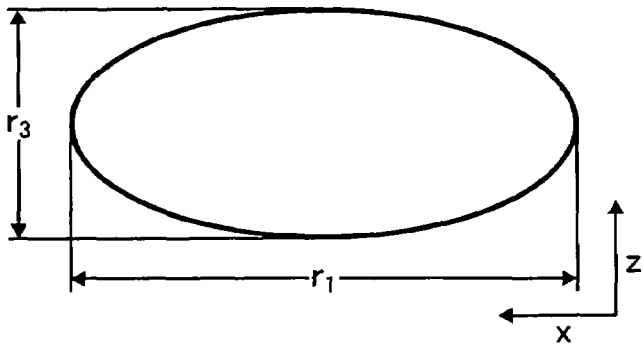
Figure 2C:
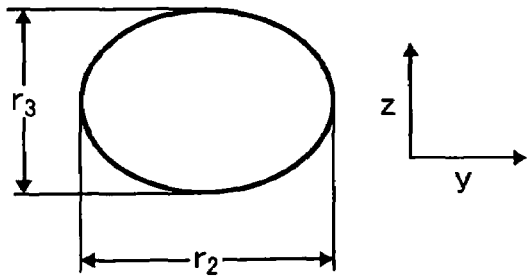

The toner of the present invention may have a form similar to the spherical form. FIG. 2A is an external view of the toner, and FIGS. 2B and 2C are cross sections of the toner. The toner preferably satisfies the following relationship:

$$0.5\leqq(r2/r1)\leqq1.0 \text{ and } 0.7\leqq(r3/r2)\leqq1.0$$

wherein r1, r2 and r3 represent the average major axis particle diameter, the average minor axis particle diameter and the average thickness of particles of the toner, wherein $r3\leqq r2\leqq r1$.

When the ratio (r2/r1) is too small, the toner has a form far away from the spherical form, and therefore the toner has a poor dot reproducibility and transferability, resulting in deterioration of the image quality. When the ratio (r3/r2) is too small, the toner has a form far away from the spherical form, and therefore the toner has a poor transferability. When the ratio (r3/r2) is 1.0, the toner has a form similar to the spherical form, and therefore the toner has a good fluidity.

The above-mentioned size factors (i.e., r1, r2 and r3) of toner particles can be determined by observing the toner particles with a scanning electron microscope while the viewing angle is changed.

Colorant

Specific examples of the colorants for use in the present invention include, but are not limited to, any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The toner preferably includes the colorant in an amount of from 1 to 15% by weight, and more preferably from 3 to 10% by weight.

The colorant for use in the present invention can be combined with a resin to be used as a master batch. Specific examples of the resin for use in the master batch pigment or for use in combination with master batch pigment include, but are not limited to, styrene polymers and substituted styrene polymers such as polystyrene, poly-p-chlorostyrene and polyvinyltoluene; styrene-vinyl copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Release Agent

Any known waxes can be used for the toner of the present invention. Specific examples of the waxes include, but are not limited to, polyolefin waxes (e.g., polyethylene waxes and polypropylene waxes), hydrocarbons having a long chain (e.g., paraffin waxes and SASOL waxes), and waxes having a carbonyl group. Among these, waxes having a carbonyl group are preferably used. Specific examples of the waxes having a carbonyl group include, but are not limited to, esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkanoic acid esters are preferably used.

The wax typically has a melting point of from 40 to 160° C., preferably 50 to 120° C., and more preferably from 60 to 90° C. When the melting point is too low, thermostable preservability of the toner deteriorates. When the melting point is too high, the toner tends to cause a cold offset when the toner is fixed at low temperature. The wax preferably has a viscosity of from 5 to 1000 cps, and more preferably from 10 to 100 cps, at a temperature of 20° C. higher than the melting point thereof. When the viscosity is too high, hot offset resistance and low temperature fixability of the toner deteriorates. The toner typically includes a wax in an amount of from 0 to 40% by weight, and preferably from 3 to 30% by weight.

Charge Controlling Agent

The toner of the present invention may optionally include a charge controlling agent. Specific examples of the charge controlling agent include, but are not limited to, any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10% by weight, and preferably from 0.2 to 5% by weight, based on the binder resin included in the toner. When the content is too high, the toner has too large a charge quantity, and thereby the electrostatic force of a developing roller attracting the toner increases, resulting in deterioration of the fluidity of the toner and image density of the toner images. The charge controlling agent can be melt-kneaded with a master batch or a binder resin, or directly dissolved in an organic solvent, or fixed on the surface of the toner.

External Additive

Toner particles are preferably mixed with an external additive to improve fluidity, developability and chargeability of the toner. Inorganic fine particles are typically used as the external additive. Inorganic particulate materials having a primary particle diameter of from 5 nm to 2 μm, and preferably from 5 nm to 500 nm, are preferably used. The surface area of the inorganic particulate materials is preferably from 20 to 500 $m^2/g$ when measured by a BET method. The content of the inorganic particulate material is preferably from 0.01% to 5.0% by weight, and more preferably from 0.01% to 2.0% by weight, based on the total weight of the toner. Specific examples of such inorganic particulate materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer selected from polystyrenes, polymethacrylates, and polyacrylate copolymers, which are prepared by a polymerization method, selected from soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include, but are not limited to, silane coupling agents, silylation agents, silane coupling agents having a fluorinated alkyl group, organic titanate coupling agents, aluminum coupling agents, silicone oils, modified silicone oils, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agents include, but are not limited to, fatty acids and their metal salts such as stearic acid, zinc stearate, and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

Two-Component Developer

When the toner of the present invention is used for a two-component developer, the toner is mixed with a magnetic carrier. The two-component developer preferably includes the toner in an amount of from 1 to 10 parts by weight, based on 100 parts of the magnetic carrier. Any known carriers such as iron powders, ferrite powders, magnetite powders, and magnetic resin carriers, having a particle diameter of from 20 to 200 μm can be used.

Specific examples of resins for use in the cover layer of the carrier include, but are not limited to, amino resins (e.g., urea-formaldehyde resins, melamine resins, benzoguanamine resins, urea resins, polyamide resins, epoxy resins), polyvinyl and polyvinylidene resins (e.g., acrylic resins, polymethyl methacrylate, polyacrylonitrile, polyvinyl acetate, polyvinyl alcohol, polyvinyl butyral), polystyrene resins (e.g., polystyrene, styrene-acrylic copolymer), halogenated olefin resins (e.g., polyvinyl chloride), polyester resins (e.g., polyethylene terephthalate, polybutylene terephthalate), polycarbonate resins, polyethylene, polyvinyl fluoride, polyvinylidene fluoride, polytrifluoroethylene, polyhexafluoropropylene, copolymer of vinylidene fluoride and acrylic monomer, copolymer of vinylidene fluoride and vinyl fluoride, fluoroterpolymers (e.g., terpolymer of tetrafluoroethylene and vinylidene fluoride and non-fluoride monomer), silicone resins, etc.

The resins for use in the cover layer of the carrier optionally include conductive particulate materials. Specific examples of the conductive materials include, but are not limited to, metal powders, carbon black, titanium oxide, tin oxide, zinc oxide, etc. The conductive particulate material preferably has an average particle diameter of not greater than 1 μm. When the average particle diameter is too small, it is difficult to control the electrical resistance of the carrier.

The toner of the present invention can be used as a one-component magnetic or non-magnetic toner which does not use a carrier.

Image Forming Apparatus

Next, an image forming apparatus using the toner of the present invention will be explained in detail.

Figure 3:
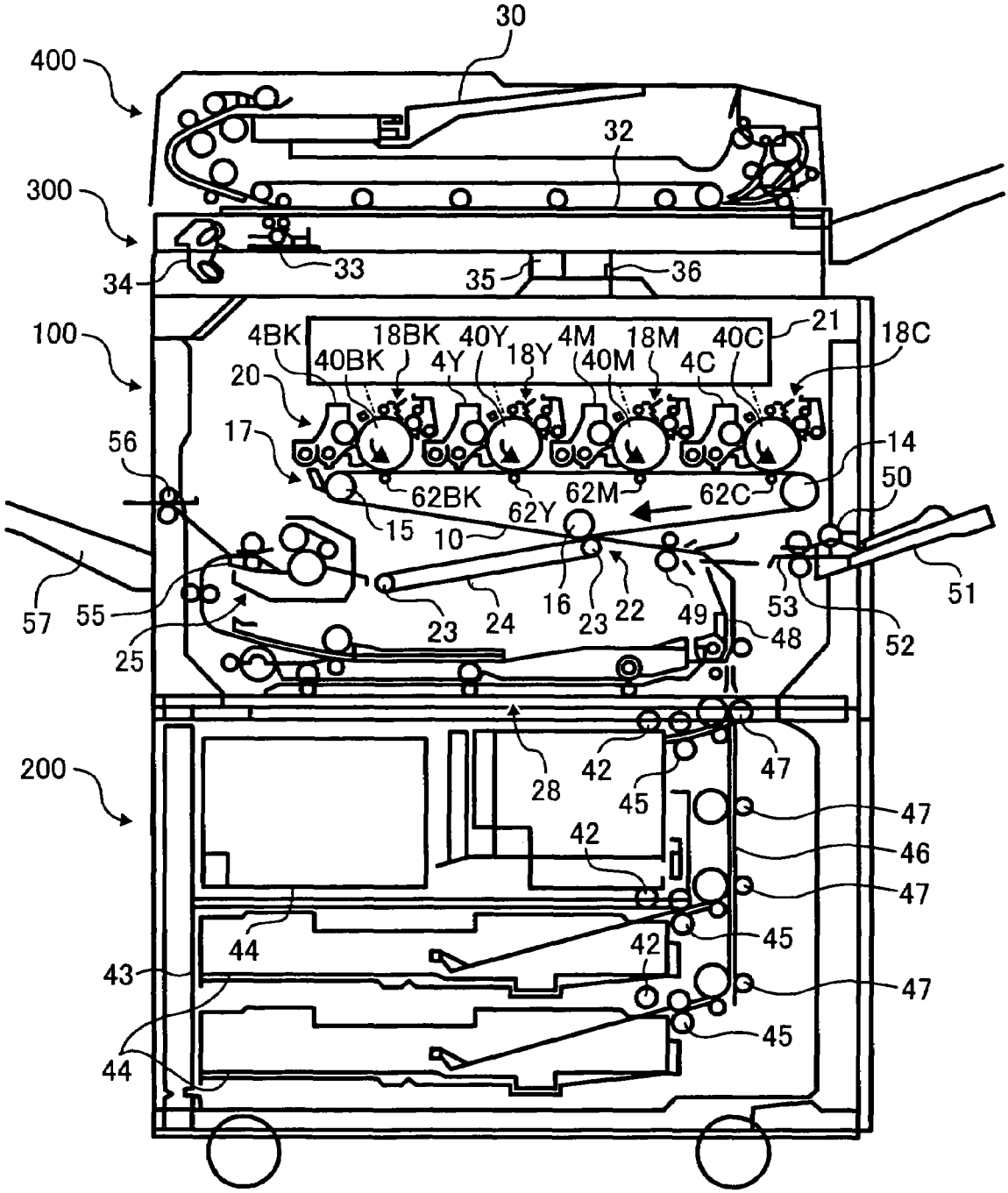
FIG. 3 is a schematic view illustrating an embodiment of an image forming apparatus using the toner of the present invention.

FIG. 3 is a schematic view illustrating an embodiment of the image forming apparatus using the toner of the present invention. An image forming apparatus illustrated in FIG. 3 includes a main body 100, a paper feeding table 200, a scanner 300 arranged above the main body and an automatic document feeder (ADF) 400.

The main body 100 includes a tandem-type image forming apparatus 20. The image forming apparatus 20 includes image forming units 18Bk, 18Y, 18M and 18C arranged in parallel. Each of the image forming units 18Bk, 18Y, 18M and 18C includes a respective photoreceptor 40Bk, 40Y, 40M and 40C served as an image bearing member, and electrophotographic image forming devices such as a charging device, a developing device, a cleaning device, etc. are arranged around each of the photoreceptor.

A light irradiator 21, configured to irradiate the photoreceptors 40Bk, 40Y, 40M and 40C with a laser light corresponding to image information to form electrostatic latent images thereon, is arranged above the tandem-type image forming apparatus 20. An intermediate transfer belt 10 made of an endless belt is arranged so as to face the photoreceptors 40Bk, 40Y, 40M and 40C included in the tandem-type image forming apparatus 20. Primary transfer devices 62Bk, 62Y, 62M and 62C configured to transfer toner images formed on each photoreceptors 40Bk, 40Y, 40M and 40C to the intermediate transfer belt 10, are arranged on the opposite side of the intermediate transfer belt 10 relative to the photoreceptors 40Bk, 40Y, 40M and 40C, respectively.

A secondary transfer device 22 configured to transfer the toner image formed on the intermediate transfer belt 10 to a transfer paper fed from the paper feeding table 200, is arranged below the intermediate transfer belt 10. The secondary transfer device 22 includes a secondary transfer belt 24 made of an endless belt tightly stretched by two rollers 23. The secondary transfer device 22 is arranged so as to press a support roller 16 via the intermediate transfer belt 10 so that the toner image formed on the intermediate transfer belt 10 is transferred onto the transfer paper. A fixing device 25 configured to fix the toner image on the transfer paper is arranged beside the secondary transfer device 22.

The secondary transfer device 22 feed the transfer paper having the toner image thereon to the fixing device 25. Of course, the secondary transfer device 22 can include a transfer roller or a non-contact charger. But in this case, it is difficult for the secondary transfer device 22 to feed the transfer paper.

The image forming apparatus illustrated in FIG. 3 includes a reverse unit 28 configured to record images on both sides of the transfer paper. The reverse unit 28 is arranged in parallel with the tandem-type image forming apparatus 20 below the secondary transfer device 22 and the fixing device 25.

The image forming units 18Bk, 18Y, 18M and 18C include developing device 4Bk, 4Y, 4M and 4C, respectively. Each of the developing devices contains a developer including the toner of the present invention. In each of the developing devices 4Bk, 4Y, 4M and 4C, a developer bearing member bears and transports a developer to an area facing an electrostatic latent image formed on each of the photoreceptors 40Bk, 40Y, 40M and 40C, and an AC bias is applied to the area, resulting in development of the electrostatic latent image. By applying the AC bias to the developer, a charge quantity distribution of the toner can be narrowed, and therefore the developability of the toner increases.

Each of the photoreceptors 40Bk, 40Y, 40M and 40C and each of the developing devices 4Bk, 4Y, 4M and 4C can be included in a process cartridge, respectively. The process cartridge may be detachably attachable to the image forming apparatus. The process cartridge can further include a charging means and a cleaning means.

Next, a procedure for forming a full color image by the image forming apparatus illustrated in FIG. 3 will be explained. An original document is set to a document feeder 30 included in the automatic document feeder (ADF) 400, or placed on a contact glass 32, included in the scanner 300.

When a start switch button (not shown) is pushed, the scanner 300 starts to drive, and a first runner 33 and a second runner 34 start to move. When the original document is set to the document feeder 30, the scanner 300 starts to drive after the original document is fed on the contact glass 32. The original document is irradiated with a light emitted by a light source via the first runner 33, and the light reflected from the original document is then reflected by a mirror included in the second runner 34. The light passes through an imaging lens 35 and is received by a reading sensor 36. Thus, image information is read.

On the other hand, when the start switch button is pushed, one of support rollers 14, 15 and 16 starts to rotate by a driving motor (not shown), and then another two support rollers start to rotate due to rotation force of the firstly-rotating support roller. Therefore, the intermediate transfer belt 10 starts to rotate. At the same time, a black image, a yellow image, a magenta image and a cyan image are respectively formed on respective photoreceptors 40Bk, 40Y, 40M and 40C in respective image forming units 18Bk, 18Y, 18M and 18C. Each of the color images is transferred one by one onto the intermediate transfer belt 10 so that a full color image is formed thereon.

On the other hand, when the start switch button is pushed, in the paper feeding table 200, a recording paper is fed from one of multistage paper feeding cassettes 44, included in a paper bank 43, by rotating one of paper feeding rollers 42. The recording paper is separated by separation rollers 45 and fed to a paper feeding path 46. Then the recording paper is transported to a paper feeding path 48, included in the main body 100, by transport rollers 47, and is stopped by a registration roller 49.

When the recording paper is fed from a manual paper feeder 51 by rotating a paper feeding roller 50, the recording paper is separated by a separation roller 52 and fed to a manual paper feeding path 53, and is stopped by the registration roller 49.

The recording paper is timely fed to an area formed between the intermediate transfer belt 10 and the secondary transfer device 22, by rotating the registration roller 49, to meet the full color toner image formed on the intermediate transfer belt 10. The full-color toner image is transferred onto the recording paper with the secondary transfer device 22.

The recording paper having the toner image thereon is transported from the secondary transfer device 22 to the fixing device 25. The toner image is fixed on the recording material by application of heat and pressure thereto with the fixing device 25. The recording paper is switched by a switch pick 55 and ejected by an ejection roller 56 and then stacked on an ejection tray 57. When the recording paper is switched by the switch pick 55 to be reversed in the reverse device 28, the recording paper is fed to a transfer area again in order to be formed a toner image on the backside thereof. And then the recording paper is ejected by the ejection roller 56 and stacked on the ejection tray 57.

Toner particles remaining on the intermediate transfer belt 10 are removed using the cleaning device 17 in preparation for the next image forming.

Figure 4:
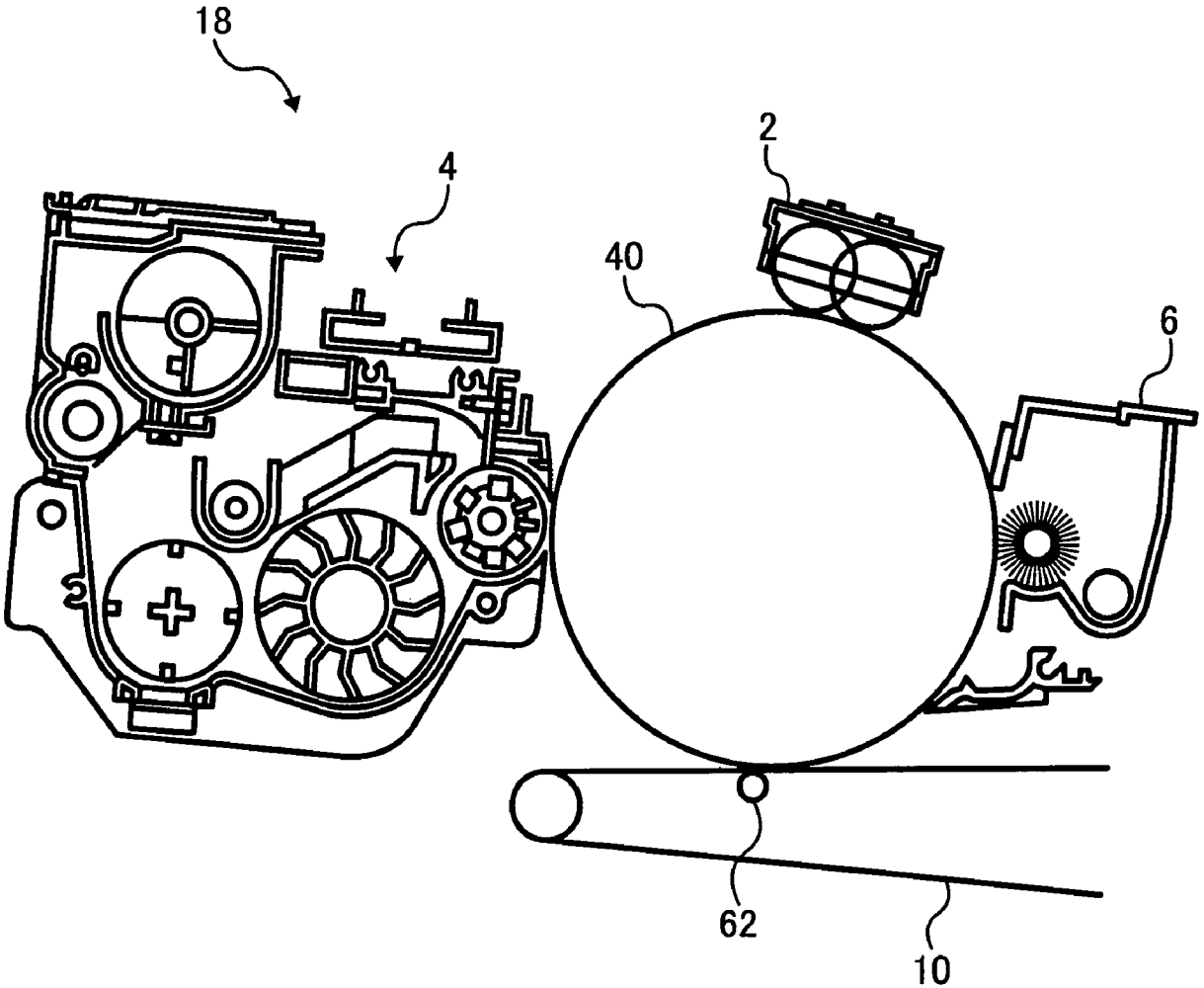
FIG. 4 is a schematic view illustrating an embodiment of an image forming unit of the image forming apparatus illustrated in FIG. 3.

FIG. 4 is a schematic view illustrating an embodiment of the image forming units 18Bk, 18Y, 18M and 18C. The image forming units 18Bk, 18Y, 18M and 18C have the same configuration, therefore only one image forming unit is shown in FIG. 4. Symbols Bk, Y, M and C, which represent each of the colors, are omitted from the reference number.

The image forming unit 18 includes the photoreceptor 40, a charging device 2 configured to uniformly charge the photoreceptor 40, the light irradiator 21 configured to irradiate the photoreceptor 40 with a laser light corresponding to image information to form electrostatic latent images thereon (not shown in FIG. 4), the developing device 4 configured to form a toner image on the photoreceptor 40 by developing an electrostatic latent image with a toner, the primary transfer device 62 configured to transfer the toner image onto the intermediate transfer belt 10, a cleaning device 6, and a neutralization device (not shown). The image forming unit 18 may includes a toner recycle mechanism including a collected-toner transport mechanism configured to transport toner particles collected by the cleaning device 6 to the developing device 4, resulting in resource saving.

Figure 5:
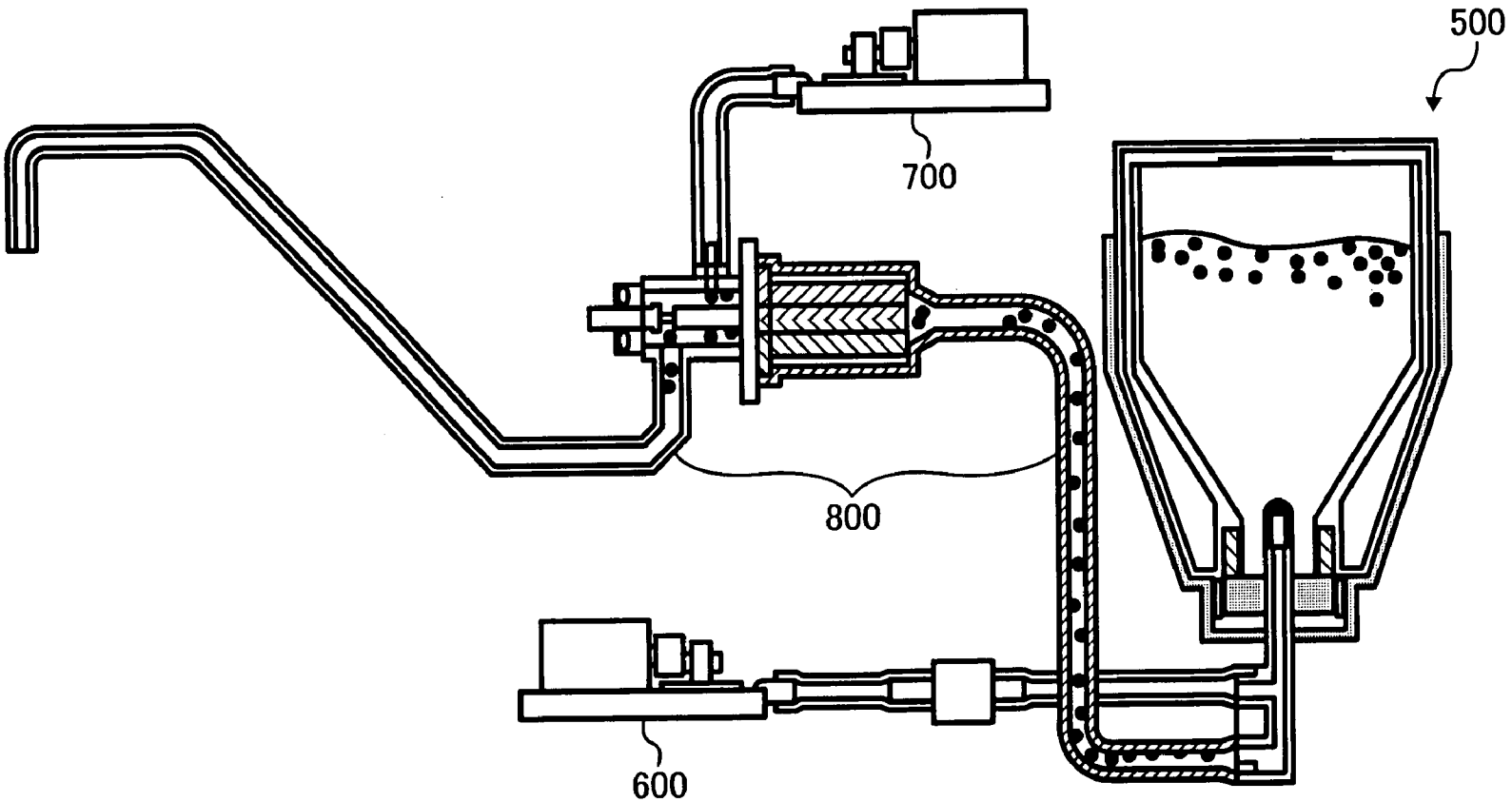
FIG. 5 is a schematic view illustrating an embodiment of a toner feeding device for feeding the toner of the present invention.

FIG. 5 is a schematic view illustrating an embodiment of a toner feeding device configured to feed the toner of the present invention. The toner is fed to the developing device of the image forming apparatus from a toner container 500, by the toner feeding device including air pumps 600 and 700 configured to flow the toner, and a tube 800 configured to transport the toner.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Particulate Epoxy Resin

In a reaction vessel equipped with a stirrer and a thermometer, 47 parts of a polyethylene oxide adduct of styrenated phenol (ELEMINOL HB-12 from Sanyo Chemical Industries, Ltd.) and 232 parts of diglycidyl ether of bisphenol A (EPIKOTE 828 from Shell Chemicals Limited) were contained and uniformly mixed. Water was dropped thereto while the mixture was agitated. When 31 parts of the water was added, the mixture started to emulsify and become milky. Further, 224 parts of water was dropped thereto. Thus an emulsion (1) was prepared.

After the emulsion (1) was heated to 70° C., a mixture of 20 parts of ethylenediamine and 446 parts of water was dropped thereto over a period of 2 hours while keeping a reaction temperature at 70° C. The emulsion was reacted and aged for 5 hours at 70° C. and 5 hours at 90° C. Thus, an aqueous dispersion of an amine cured epoxy resin (i.e., particulate resin dispersion (A1)) was prepared.

A volume average particle diameter measured by the particulate resin dispersion (A1) using a laser-type PARTICLE SIZE DISTRIBUTION ANALYZER LA-920 from Horiba, Ltd. was 0.81 μm. A part of the particulate resin dispersion (A1) was separated by centrifugation. The separated particulate resin was further subjected to centrifugation after adding water thereto. After repeating this operation twice, the resin was isolated and dried. The resin had a glass transition temperature (Tg) of 120° C. (measured by DSC).

In a reaction vessel equipped with a stirrer and a thermometer, 787 parts of a polycaprolactone diol (having molecular weight of 2000) and 800 parts of a polyether diol (having molecular weight of 4000, EO content of 50% by weight, PO content of 50% by weight) were contained. The mixture was dehydrated under reduced pressure at 120° C. The mixture included 0.05% weight of water after the dehydration.

Next, 55.5 parts of HDI (hexamethylene diisocyanate), 65.5 parts of hydrogenated MDI (4,4'-diphenylmethane diisocyanate), and 0.6 parts of dibutyltin dilaurate were added thereto. The mixture was reacted for 5 hours at 80° C. Thus, a water-soluble polymer (1) was prepared.

Next, 100 parts of the particulate resin dispersion (A1), 1 part of the water-soluble polymer (1), and 107 parts of water were mixed. Thus, a milky liquid (i.e., a particulate resin dispersion (1)) was prepared.

Preparation of Particulate Styrene-Methacrylic Acid Copolymer Resin

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 139 parts of styrene, 138 parts of methacrylic acid, and 1 part of ammonium persulfate were contained and the mixture was agitated with the stirrer for 15 minutes at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion (i.e., a particulate resin dispersion (A2)) of a vinyl resin (i.e., a copolymer of styrene/methacrylic acid/sodium salt of sulfate of ethylene oxide adduct of methacrylic acid) was prepared.

A volume average particle diameter measured by the particulate resin dispersion (A2) using a laser-type PARTICLE SIZE DISTRIBUTION ANALYZER LA-920 from Horiba, Ltd. was 0.15 μm. A part of the particulate resin was isolated and dried. The resin had a glass transition temperature (Tg) of 154° C. (measured by DSC).

Next, 784 parts of water, 136 parts of the particulate resin dispersion (A2), and 80 parts of an aqueous solution of a sodium salt of dodecyldiphenyl ether disulfonic acid (ELEMINOL MON-7 from Sanyo Chemical Industries Ltd., solid content of 48.5%) were mixed. Thus, a particulate resin dispersion (2) was prepared.

Preparation of Polyester Resin

The following components were fed in a reaction vessel equipped with a condenser, a stirrer and a nitrogen feed pipe.

| | |
|---|---|
| Ethylene oxide (2 mole) adduct of bisphenol A | 220 parts |
| Propylene oxide (3 mole) adduct of bisphenol A | 561 parts |
| Terephthalic acid | 218 parts |
| Adipic acid | 48 parts |
| Dibutyltin oxide | 2 parts |

The mixture was reacted for 8 hours at 230° C. under normal pressure. Then the reaction was further continued for 5 hours under a reduced pressure of from 10 to 15 mmHg. Further, 45 parts of trimellitic anhydride was fed to the container to be reacted with the reaction product for 2 hours at 180° C. Thus, a polyester (1) was prepared.

The polyester (1) had a number average molecular weight of 2500, a weight average molecular weight of 6700, Tg of 43° C., and an acid value of 25 mgKOH/g.

Next, 1000 parts of the polyester (1) was dissolved in 2000 parts of an ethyl acetate. Thus, a polyester resin solution (1) was prepared.

Preparation of Polyester Resin Using Cyclic Ester

The following components were fed in a reaction vessel equipped with a condenser, a stirrer and a nitrogen feed pipe.

| | |
|---|---|
| Glycerin | 9 parts |
| L-lactide | 288 parts |
| Dibutyltin oxide | 2 parts |

The mixture was subjected to a ring-opening polymerization for 6 hours at 160° C. under normal pressure. Thus, a polyester (2) was prepared.

The polyester (2) had a number average molecular weight of 3000, a weight average molecular weight of 6300, Tg of 49° C., and an acid value of 8 mgKOH/g.

Next, 1000 parts of the polyester (2) was dissolved in 2000 parts of an ethyl acetate. Thus, a polyester resin solution (2) was prepared.

Preparation of Polyester Prepolymer

In a reaction vessel equipped with a stirrer and a thermometer, 2000 parts of a polyester resin (prepared by a dehydration condensation of EO 2 mol adduct of bisphenol A with terephthalic acid) having a hydroxyl value of 56 mgKOH/g was contained and subjected to a dehydration for 1 hour at 110° C. under reduced pressure of 3 mmHg. Next, 457 parts of isophorone diisocyanate (IPDI) was added thereto, and the mixture was reacted for 10 hours at 110° C. Thus, a polyester prepolymer (1) having an isocyanate group on its end was prepared.

The polyester prepolymer (1) included free isocyanate in an amount of 3.6% by weight.

Preparation of Polyester Prepolymer Using Cyclic Ester

In a reaction vessel equipped with a stirrer and a thermometer, 2000 parts of a polyester diol (prepared by a ring-opening polymerization of 6 parts of ethylene glycol and 200 parts of L-lactide for 8 hours at 160° C.) having a hydroxyl value of 56 mgKOH/g was contained and subjected to a dehydration for 1 hour at 110° C. under reduced pressure of 3 mmHg. Next, 457 parts of isophorone diisocyanate (IPDI) was added thereto, and the mixture was reacted for 10 hours at 110° C. Thus, a polyester prepolymer (2) having an isocyanate group on its end was prepared.

The polyester prepolymer (2) included free isocyanate in an amount of 3.6% by weight, and has Tg of 65° C. and an acid value of 15 mgKOH/g.

Example 1

In a beaker, 240 parts of the polyester resin solution (2), 20 parts of trimethylolpropane tribehenate (i.e., release agent, having a melting point of 58° C. and melt viscosity of 24 cps), and 4 parts of copper phthalocyanine (i.e., colorant) were contained. The mixture was agitated at 50° C. using TK HOMO MIXERS (from Tokushu Kika Kogyo Co., Ltd.) at a revolution of 12000 rpm. Thus, a colorant dispersion (1) was prepared.

In another beaker, 500 parts of ion-exchange water, 500 parts of the particulate resin dispersion (1), and 0.2 parts of sodium dodecylbenzenesulfonate were contained and mixed uniformly. The mixture was heated to 50° C. and agitated using TK HOMO MIXER® (from Tokushu Kika Kogyo Co., Ltd.) at a revolution of 12000 rpm. Then 300 parts of the colorant dispersion (1) was added thereto, and the mixture was further agitated for 10 minutes. Next, the mixture was fed to a conical flask equipped with a stirrer and a thermometer, and heated to remove the ethyl acetate. Thus, a colored particulate resin dispersion was prepared.

The colored particulate resin dispersion was subjected to filtering and drying to prepare a colored particulate resin. Then 100 parts of the colored particulate resin were mixed with 0.7 parts of a hydrophobized silica and 0.3 parts of a hydrophobized titanium oxide using a HENSCHEL MIXER. Thus, a toner (T1) was prepared.

Example 2

In a beaker, 500 parts of the particulate resin dispersion (2) was contained and heated to 50° C. and agitated using TK HOMO MIXER® (from Tokushu Kika Kogyo Co., Ltd.) at a revolution of 12000 rpm. Then 214 parts of the colorant dispersion (1) was added thereto, and the mixture was further agitated for 10 minutes. Next, the mixture was fed to a conical flask equipped with a stirrer and a thermometer, and heated to remove the ethyl acetate. Thus, a colored particulate resin dispersion was prepared.

Next, 100 parts of a 5% aqueous solution of sodium hydroxide was added to 100 parts of the colored particulate resin dispersion. The mixture was agitated for 10 minutes at 40° C. using TK HOMO MIXER® (from Tokushu Kika Kogyo Co., Ltd.) at a revolution of 12000 rpm to dissolve the particulate resin remaining on the surface of the colored particulate resin. Next, the mixture was subjected to centrifugation to remove supernatant liquid. The mixture was further subjected to centrifugation after adding 100 parts of water thereto. After repeating this operation twice, the mixture was dried to prepare a colored particulate resin.

Then 100 parts of the colored particulate resin were mixed with 0.7 parts of a hydrophobized silica and 0.3 parts of a hydrophobized titanium oxide using a HENSCHEL MIXER. Thus, a toner (T2) was prepared.

Example 3

In a beaker, 240 parts of the polyester resin solution (2), 20 parts of the polyester prepolymer (2), 40 parts of ethyl acetate, 20 parts of trimethylolpropane tribehenate, and 4 parts of copper phthalocyanine were contained. The mixture was agitated at 50° C. using TK HOMO MIXER® (from Tokushu Kika Kogyo Co., Ltd.) at a revolution of 12000 rpm. Thus, a colorant dispersion (2) was prepared.

In another beaker, 500 parts of the particulate resin dispersion (2) was contained and heated to 50° C. and agitated using TK HOMO MIXERS (from Tokushu Kika Kogyo Co., Ltd.) at a revolution of 12000 rpm. Then a mixture liquid (1) including 1 part of a curing agent and 214 parts of the colorant dispersion (2) was added thereto immediately after the mixture liquid (1) was prepared. The mixture was further agitated for 10 minutes. Next, the mixture was fed to a conical flask equipped with a stirrer and a thermometer, and heated to remove the ethyl acetate. The mixture was further heated to 98° C. and reacted for 5 hours. Thus, a colored particulate resin dispersion was prepared.

Next, 100 parts of a 5% aqueous solution of sodium hydroxide was added to 100 parts of the colored particulate resin dispersion. The mixture was agitated for 10 minutes at 40° C. using TK HOMO MIXER® (from Tokushu Kika Kogyo Co., Ltd.) at a revolution of 12000 rpm to dissolve the particulate resin remaining on the surface of the colored particulate resin. Next, the mixture was subjected to centrifugation to remove a supernatant liquid. The mixture was further subjected to centrifugation after adding 100 parts of water thereto. After repeating this operation twice, the mixture was dried to prepare a colored particulate resin.

Then 100 parts of the colored particulate resin were mixed with 0.7 parts of a hydrophobized silica and 0.3 parts of a hydrophobized titanium oxide using a HENSCHEL MIXER. Thus, a toner (T3) was prepared.

Comparative Example 1

The procedure for preparation of the toner (T2) in Example 2 was repeated except that the polyester resin solution (2) was replaced with the polyester resin solution (1). Thus, a comparative toner (RT1) was prepared.

Comparative Example 2

The procedure for preparation of the toner (T3) in Example 3 was repeated except that the polyester resin solution (2) and the polyester prepolymer (2) were respectively replaced with the polyester resin solution (1) and the polyester prepolymer (1). Thus, a comparative toner (RT2) was prepared.

Evaluation 1

The thus prepared toners (T1), (T2), (T3), (RT1), and (RT2) were evaluated as follows.

(1) Particle Diameter and Particle Diameter Distribution

A particle diameter distribution of a toner was measured using an instrument Multisizer™ 3 COULTER COUNTER® (from Beckman Coulter Inc.) and a volume average particle diameter (D4) and a number average particle diameter (D1) were calculated. The diameter of the aperture was 100 μm.

(2) Fixability

A developer was prepared by mixing 7 parts of a toner and 93 parts of a Cu—Zn ferrite carrier covered by a silicone resin and having an average particle diameter of 40 μm. The developer was set in a copier IMAGIO NEO C285 (from Ricoh Co., Ltd.). The copier was controlled so that the toner was used in an amount of 1.0±0.1 mg/cm$^2$ for developing a solid image and the temperature of the fixing belt can be varied. The solid images were produced on plain papers (TYPE6200 from Ricoh Co., Ltd.) or thick papers (Copy Paper 135 from NBS Ricoh Co., Ltd.) and fixed at various temperatures to determine the minimum fixable temperature and the maximum fixable temperature at which the offset problem does not occur. The minimum fixable temperature was defined as a temperature at which the residual rate of the image density was not less than 70% when the fixed image was rubbed with a pad.

(3) Transparency

A solid image was produced on an OHP sheet (Type PPC-DX from Ricoh Co., Ltd.) using the same copier as that in the above fixability evaluation. The solid image on the OHP sheet was fixed at a fixing belt temperature of 160° C. A haze value of the fixed image was measured using a direct-reading haze computer HGM-2DP (from Suga Test Instruments). The haze value was used as a measure of the transparency of the image. As the haze value decreases, the transparency increases. The image preferably has the haze value of not greater than 30%, and more preferably not greater than 20%.

The results of the evaluations of the prepared toners (T1), (T2), (T3), (RT1), and (RT2) are shown in Table 1.

TABLE 1

| Example No. | Toner No. | D4 (μm) | D1 (μm) | D4/D1 | Average Circularity | Minimum fixable temperature (° C.) | Maximum fixable temperature (° C.) | Haze (%) |
|---|---|---|---|---|---|---|---|---|
| Ex. 1 | T1 | 6.7 | 5.4 | 1.24 | 0.945 | 135 | 165 | 18 |
| Ex. 2 | T2 | 6.5 | 5.7 | 1.14 | 0.956 | 125 | 170 | 12 |
| Ex. 3 | T3 | 6.6 | 5.7 | 1.16 | 0.942 | 125 | 210 | 15 |
| Comp. Ex. 1 | RT1 | 6.9 | 5.8 | 1.19 | 0.978 | 135 | 150 | 35 |
| Comp. Ex. 2 | RT2 | 6.4 | 5.3 | 1.21 | 0.985 | 130 | 210 | 43 |

Example 4

In an autoclave reaction vessel equipped with a thermometer and a stirrer, 100 parts of a polyoxyethylene glyceryl ether (NEWPOL PE-600 from Sanyo Chemical Industries, Ltd.), 100 parts of L-lactide, and 1 part of tin octylate were contained. After the atmosphere was replaced with nitrogen gas, the mixture was polymerized for 6 hours at 160° C. Thus, a resin (1) was prepared.

The procedure for preparation of the resin (1) was repeated except that the L-lactide was replaced with D-lactide. Thus, a resin (2) was prepared.

The resins (1) and (2) were subjected to X-ray crystal structure analysis (using an instrument AFC7R from Rigaku Corporation) to determine whether a helical structure was formed or not. As a result, the resin (1) included a left-handed helical structure and the resin (2) included a right-handed helical structure.

In a beaker, 100 parts of the resin (1) and 40 parts of ethyl acetate were contained and mixed. Further, 500 parts of water and 3 parts of sodium dodecylnaphthalenesulfonate were added thereto. The mixture was agitated for 1 minute at 25° C. using TK HOMO MIXER® (from Tokushu Kika Kogyo Co., Ltd.) at a revolution of 12000 rpm. Thus, an aqueous dispersion (1) was prepared.

The procedure for preparation of the aqueous dispersion (1) was repeated except the resin (1) was replaced with the resin (2). Thus, an aqueous dispersion (2) was prepared.

Next, the following components were mixed to prepare an aqueous dispersion (3).

| | |
|---|---|
| Aqueous dispersion (1) | 100 parts |
| Aqueous dispersion (2) | 100 parts |
| Colorant (carbon black MA-100 from Mitsubishi Chemical Corporation) | 4 parts |
| Release agent (VISCOL 550P (softening point of 150° C.) from Sanyo Chemical Industries, Ltd.) | 4 parts |
| Water | 50 parts |

The aqueous dispersion (3) was agitated for 1 minute at 25° C. using TK HOMO MIXER® (from Tokushu Kika Kogyo Co., Ltd.) at a revolution of 12000 rpm. Thus, an aqueous dispersion (4) was prepared.

The aqueous dispersion (4) was agitated for 3 hours at 50° C., followed by centrifugation. The aqueous dispersion (4) was further subjected to centrifugation after adding 100 parts of water thereto. This operation was repeated three times. Thus, a toner (T4) was prepared.

The toner (T4) had a volume average particle diameter of about 5 μm.

Comparative Example 3

In an autoclave reaction vessel equipped with a thermometer and a stirrer, 100 parts of a polyoxyethylene glyceryl ether (NEWPOL PE-600 from Sanyo Chemical Industries, Ltd.), 1000 parts of a racemic-lactide, and 1 part of tin octylate were contained. After the atmosphere was replaced with nitrogen gas, the mixture was polymerized for 6 hours at 160° C. Thus, a resin (3) was prepared.

The resin (3) was subjected to X-ray crystal structure analysis (using an instrument AFC7R from Rigaku Corporation) to determine whether a helical structure was formed or not. As a result, the resin (3) included a random structure and no helical structure.

The following components were melt-kneaded using a double-axis kneader PCM-30 (from Ikegai Ltd.), followed by cooling.

| | |
|---|---|
| Resin (3) | 100 parts |
| Colorant (carbon black MA-100 from Mitsubishi Chemical Corporation) | 4 parts |
| Release agent (VISCOL 550P (softening point of 150° C.) from Sanyo Chemical Industries, Ltd.) | 4 parts |

The cooled mixture was subjected to a coarse pulverization followed by a fine pulverization using a supersonic jet pulverizer LABO JET (from Nippon Pneumatic Mfg. Co., Ltd.). The pulverized particles were classified with an airflow classifier MDS-I (from Nippon Pneumatic Mfg. Co., Ltd.). Thus, a comparative toner (RT3) was prepared.

The toner (RT3) had a volume average particle diameter of about 9 μm.

Evaluation 2

The thus prepared toners (T4) and (RT3) were evaluated as follows.

(1) Number Average Molecular Weight

A THF-soluble part of a resin used in a toner was subjected to gel permeation chromatography (GPC) to determine a number average molecular weight. The measurement conditions were as follows.

Instrument used: HLC-8120 (from Tosoh Corporation)
Column: TSK GEL GMH6 (from Tosoh Corporation)×2
Temperature: 25° C.
Sample solution: 0.25% (by weight) solution of THF (tetrahydrofuran)
Injection volume: 200 μl
Detection device: Refractive index detector A molecular weight calibration curve was prepared using standard polystyrene.

(2) Amount of Stereocomplex

An amount of a stereocomplex can be determined by differential scanning calorimetry (DSC) using an instrument DSC-60 (from Shimadzu corporation).

As a sample of "toner before fixing", a fresh toner was used. As a sample of "toner after fixing", a toner scratched off from a solid image produced on a transparent sheet (LUMIRROR® 50-T60 from Toray Industries Inc.) by a copier was used.

About 5.0 mg of a sample was contained in a sample holder made of aluminum. The sample holder was set to a holder unit and heated from 20° C. to 250° C. at a temperature rising speed of 10° C./min under nitrogen gas atmosphere.

In this evaluation, $C_{before}$ and $C_{after}$ respectively represent areas of endothermic peaks originated from a stereocomplex, that are observed before the toner is fixed and after the toner is fixed. The endothermic peak originated from a stereocomplex is observed at a temperature of about 50° C. higher than that originated from the "toner before fixing" is observed.

(3) Melting Property

A melting starting temperature of a toner was measured using a CAPILLARY RHEOMETER SHIMADZU FLOWMETER CFT-500D (from Shimadzu Corporation) and a flow test was performed under the following conditions.

Plunger: 1 $cm^2$
Die diameter: 1 mm
Load: 20 KgF
Preheating temperature: 50 to 80° C.
Preheating time: 300 sec
Temperature rising speed: 6° C./min A temperature at which the plunger starts to flow is defined as the melting starting temperature.

(4) Fixing Property

A toner was set in a copier AR5030 (from Sharp Corporation) and unfixed images were produced. The unfixed images were fixed at various temperatures using a modified fixing unit of a full-color copier LBP-2160 (from Canon Inc.) so that the temperature of the heat roller can be varied. The process speed of the fixing unit was 80 mm/sec.

The minimum fixable temperature (MFT) was defined as a temperature at which the residual rate of the image density was not less than 70% when the fixed image was rubbed with a cloth pad. The hot offset occurrence temperature (HOT) was defined as a temperature at which a hot offset started to be visually observed.

The results of the evaluations of the prepared toners (T4) and (RT3) are shown in Table 2.

TABLE 2

| | Example No. | |
|---|---|---|
| | Example 4 | Comparative Example 3 |
| Toner No. | T4 | RT3 |
| Resin composition | D-form/L-form = 1/1 | Racemic form |
| Number average molecular weight | 6000 | 6000 |
| Formation of stereocomplex | Yes | No |
| Amount of stereocomplex | $C_{before} < C_{after}$ | $C_{before} = C_{after}$ |
| Melting starting temperature (° C.) | 99 | 102 |
| MFT (° C.) | 105 | 115 |
| HOT (° C.) | 225 | 180 |

This document claims priority and contains subject matter related to Japanese Patent Application No. 2005-207650, filed on July 15, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, manufactured by a method comprising:

dispersing toner constituents including a resin, in an aqueous medium containing a particulate resin, wherein the resin comprises a polyester skeleton formed by a ring-opening addition reaction of a cyclic ester with a first compound having an active hydrogen group.

2. The toner according to claim 1, wherein the cyclic ester has an optical activity.

3. The toner according to claim 2, wherein the cyclic ester has 3 to 6 carbon atoms comprising an asymmetric carbon atom.

4. The toner according to claim 2, wherein the cyclic ester is L-lactide or D-lactide.

5. The toner according to claim 2, wherein the resin comprises:

a first resin (A) having a polyester skeleton originated from one optical isomer of the cyclic ester; and a second resin (B) having a polyester skeleton originated from the other optical isomer of the cyclic ester.

6. The toner according to claim 5, which satisfies the following relationship:

$$C_{before<Cafter}$$

wherein $C_{before}$ represents an amount of a stereocomplex existing in the toner, and $C_{after}$ represents an amount of a sterocomplex existing in a fixed image using the toner.

7. The toner according to claim 5, comprising:

first toner particles comprising the first resin (A); and second toner particles comprising the second resin (B), wherein the first resin (A) and the second resin (B) form a stereocomplex.

8. The toner according to claim 5, comprising aggregated particles, comprising:

first primary particles comprising the first resin (A); and second primary particles comprising the second resin (B), wherein the first resin (A) and the second resin (B) form a stereocomplex.

9. The toner according to claim 8, wherein the toner is not subjected to a temperature of not less than 90° C. after the aggregated particles are formed until the toner is fixed.

10. The toner according to claim 5, wherein the first resin (A) and the second resin (B) form no stereocomplex until the toner is fixed, and form a stereocomplex after the toner is fixed.

11. The toner according to claim 5, wherein the first resin (A) comprises 1 or more right-handed helical polymer unit per molecule and the second resin (B) comprises 1 or more left-handed helical polymer unit per molecule.

12. The toner according to claim 5, wherein the first resin (A) and the second resin (B) respectively comprise a skeleton originated from one optical isomer of a second optically active monomer selected from the group consisting of α-alkyl-α-hydroxycarboxylic acid, α-hydrocarbyl-α-amino acid, α-hydrocarbyl methacrylate, α-alkylethylene oxide, and α-alkylethylene sulfide.

13. The toner according to claim 12, wherein the second optically active monomer is L-lactic acid or D-lactic acid.

14. The toner according to claim 1, wherein the first compound having an active hydrogen group comprises at least one of a hydroxyl group and a carboxyl group.

15. A developer, comprising the toner according to claim 1, and a carrier.

16. An image forming method, comprising:

forming an electrostatic latent image on an image bearing member;

developing the electrostatic latent image with a toner to form a toner image on the image bearing member;

transferring the toner image onto a recording material; and fixing the toner image on the recording material, wherein the toner is the toner according to claim 1.

17. A toner container, comprising the toner according to claim 1.

18. A toner, manufactured by a method comprising:

dispersing toner constituents including a first resin and a precursor of a second resin, in an aqueous medium containing a particulate resin, wherein the precursor of the second resin reacts therein, and wherein at least one of the first resin and the precursor of the second resin comprises a polyester skeleton formed by a ring-opening addition reaction of a cyclic ester with a first compound having an active hydrogen group.

19. The toner according to claim 18, wherein the precursor of the second resin is subjected to an addition reaction with a second compound having an active hydrogen group.

20. The toner according to claim 19, wherein the precursor of the second resin comprises at least one of an isocyanate group and a blocked isocyanate group.

21. The toner according to claim 19, wherein the second compound having an active hydrogen group comprises at least one selected from the group consisting of hydroxyl group, primary amino group, and secondary amino group.

22. The toner according to claim 18, wherein a weight ratio of the second resin to the first resin is from 5/95 to 80/20.

23. The toner according to claim 18, wherein the first resin and the second resin respectively have an acid value of from 1 to 30 mgKOH/g.

24. A toner, manufactured by a method comprising:

dissolving or dispersing toner constituents including a first resin and a precursor of a second resin, in an organic solvent to prepare a toner constituent mixture liquid;

dispersing the toner constituent mixture liquid in an aqueous medium containing a particulate resin while subjecting the precursor of the second resin to a reaction, to prepare a dispersion containing toner particles;

removing the organic solvent from the dispersion to prepare toner particles, wherein at least one of the first resin and the precursor of the second resin comprises a polyester skeleton formed by a ring-opening addition reaction of a cyclic ester with a first compound having an active hydrogen group.

* * * * *